US008562361B2

(12) United States Patent
Corbett et al.

(10) Patent No.: US 8,562,361 B2
(45) Date of Patent: Oct. 22, 2013

(54) UNIVERSAL GROUND ADAPTER FOR MARINE CABLES

(75) Inventors: Blaise L. Corbett, King George, VA (US); David J. Griffiths, King George, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 76 days.

(21) Appl. No.: 13/385,470

(22) Filed: Jan. 26, 2012

(65) Prior Publication Data

US 2013/0090004 A1 Apr. 11, 2013

Related U.S. Application Data

(60) Provisional application No. 61/628,298, filed on Oct. 11, 2011.

(51) Int. Cl.
*H01R 4/66* (2006.01)

(52) U.S. Cl.
USPC ..... 439/100

(58) Field of Classification Search
USPC ..... 439/862, 860, 868, 883, 609, 578, 389, 439/92, 100
See application file for complete search history.

(56) References Cited

U.S. PATENT DOCUMENTS

| | | | | |
|---|---|---|---|---|
| 4,022,966 | A * | 5/1977 | Gajajiva | 174/653 |
| 4,273,405 | A * | 6/1981 | Law | 439/462 |
| 4,515,991 | A * | 5/1985 | Hutchison | 174/654 |
| 4,687,263 | A | 8/1987 | Cosmos et al. | 439/108 |
| 4,772,212 | A | 9/1988 | Sotolongo | 439/98 |
| 4,904,826 | A | 2/1990 | Dixon | 174/35 |
| 5,308,250 | A | 5/1994 | Walz | 439/63 |
| 5,477,159 | A | 12/1995 | Hamling | 324/754 |
| 6,027,349 | A * | 2/2000 | Chang | 439/101 |

(Continued)

OTHER PUBLICATIONS

Glenair Installation Instructions—Threaded-Stem Stuffing Tube. http://www.airmartechnology.com/uploads/installguide/17-423-01.pdf.

(Continued)

*Primary Examiner* — Neil Abrams
*Assistant Examiner* — Phuongchi T Nguyen
(74) *Attorney, Agent, or Firm* — Gerhard W. Thielman, Esq

(57) ABSTRACT

An electrical conduit ground device is provided for electrically and environmentally shielding an electric cable. The device includes a conduit having a receiving end through which the cable passes axially; an internal seal that inserts into the receiving end; a gland boss that inserts into the receiving end; an external seal that inserts into the boss and extends axially outward from the receiving end; and a grounding assembly disposed between the internal and external seals. The assembly includes an adapter for providing electrical grounding contact between the cable and the swage tube; a space-retainer for structurally supporting the adapter; and a washer for axially separating the internal and external seals. The adapter is provided for electrically connecting an interior surface of a conduit and an external surface of a cable. The adapter includes an electrically conductive and mechanically flexible sheet having first and second edges that can face each other, the sheet being configured to form an annulus that mechanically contacts the external surface of the cable and a periphery that mechanically contacts the inner surface of the conduit.

19 Claims, 20 Drawing Sheets

(56) References Cited

U.S. PATENT DOCUMENTS

| | | | | |
|---|---|---|---|---|
| 6,062,910 | A | 5/2000 | Braquet et al. | 439/620 |
| 6,406,330 | B2 * | 6/2002 | Bruce | 439/607.19 |
| 6,468,100 | B1 * | 10/2002 | Meyer et al. | 439/320 |
| 6,683,773 | B2 * | 1/2004 | Montena | 361/119 |
| 7,942,679 | B1 | 5/2011 | Gretz | 439/108 |
| 8,299,362 | B2 * | 10/2012 | Vaughan | 174/72 A |

OTHER PUBLICATIONS

MIL-S-24235/2C(SH), Military Specification Sheet—Stuffing Tube, Dec. 28, 1992. http://dornequipment.com/milspecs/pdf/24235-2C.pdf.

Research Tool & Die Catalog Numbering System Stuffing Tubes. http://www.rtnd.com/catalog/4-8.pdf.

* cited by examiner

UNIVERSAL GROUND ADAPTER FOR MARINE CABLES

CROSS REFERENCE TO RELATED APPLICATION

Pursuant to 35 U.S.C. §119, the benefit of priority from provisional application 61/628,298, with a filing date of Oct. 11, 2011, is claimed for this non-provisional application.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to ground adapters for electrical cables, especially those used aboard marine vessels and platforms. In particular, the invention relates to embodiments for low-impedance designs of a cable shield ground adapter (CSGA).

The United States Navy currently employs two technologies to provide electromagnetic (EM) protection from coupling to topside (i.e., above-deck) cables; conduit which provides an overall EM shield to cables placed within the conduit, and shielded cables with CSGAs used as termination connectors. Both technologies are viable but components used are expensive and difficult to maintain. The proposed CSGA embodiments deal almost exclusively with shielded cables and conduits. These are not explicitly described herein with respect to further applications, although the technology could be applied to the conduit shell whether flexible or rigid.

Conventional CSGA designs have been proven to be effective at grounding cable shielding when properly installed, achieving grounding effectiveness measures that exceed 80 decibels (dB). The conventional designs are designed for use with swage tubes, also known as stuffing tubes. Glenair® Inc. of Glendale, Calif. provides the primary conventional design currently in use. The Glenair® configuration requires the installer to employ CSGA components designed for specific cable sizes and swage tube sizes. Failure to use the exact tube size leads to performance failure for the system. The Glenair® CSGA also requires the installer to remove and discard the gland nut typically supplied with the swage tube by the swage tube manufacturer.

Once installed, the system is not easily repaired. Repair of a failed adapter can be accomplished through one of two methods. The first method requires the disconnection of the shielded cable from the system interface connector through cutting or de-soldering, removal and replacement of the failed component, and replacement of the interface connector. The second method requires a CSGA called a "Split Connector" that represents a device used for in situ replacement of the failed CSGA.

The failed CSGA must be removed from the swage tube, and the split connector is installed in its place. The components from the failed connector are then taped to the upper part of the cable and remain in place for the life of the connector, or until the CSGA assembly is replaced during a refit. The Glenair® system uses an exterior weather proof boot to provide exterior weather protection, but lacks interior protection against water intrusion. Their catalog is available at http://www.glenair.com/catalogs/entire_catalog_shipboard.pdf for lists of parts. A 3:02-minute video presentation on "MIL-PRF-24758A Conduit Assembly and EMI Shield Termination Procedure" available at Glenair® at http://www.glenair.com/video/24758a_full_monty.htm and more generally in a 2:57-minute presentation as "MIL-PRF-24758A Shipboard Conduit Assembly" at http://www.youtube.com/watch?v=Abmj0IN_A40 (without audio). Airmar® Technology in Milford, N.H. also provides an installation guide in http://www.airmartechnology.com/uploads/installguide/17-423-01.pdf.

Another conventional CSGA design, SkinTop®, is available from LAPP Group Inc. of Florham Park, N.J. The SkinTop® design incorporates squared-off contact fingers, which in addition to forming an ohmic contact, also perform a cable centering function. Without the squaring off of the contact, the cable would tend to roll off center. The resultant structural loading imposes the requirement of stiffer materials and shorter finger lengths for the SkinTop® design. The smallest clamping cable diameter for the conventional SkinTop® design is 0.118 inch (") with a maximum variation of cable diameter of approximately 0.512" for their largest design.

Additionally, the conventional Skintop® requires the use of a machined cable gland assembly and is therefore not adaptable to variances in the inner diameter of the swage tube. This imposes limits in the design as to the exact size of the swage tube's inner diameter, the units of measure (metric or SAE) and thread type of swage tube. The SkinTop® design also requires the removal and subsequent disposal of the gland nut supplied with the swage tube by the manufacturer. The basic design of the SkinTop® system appears more robust than the Glenair® system. However once installed, the SkinTop® arrangement is not easily repaired. Repair of a failed adapter requires the disconnection of the shielded cable from the system interface connector through cutting or de-soldering, removal and replacement of the failed component, and replacement of the interface connector. The Skintop® system uses a gland washer to provide exterior weather protection, and a weather proof boot can be added to provide additional exterior weather protection. Interior protection against water intrusion is not provided.

SUMMARY

Conventional electrical ground adapters yield disadvantages addressed by various exemplary embodiments of the present invention. In particular, various exemplary embodiments provide an electrical conduit ground device for electrically and environmentally shielding an electric cable. The device includes a conduit having a receiving end through which the cable passes axially; an internal seal that inserts into the receiving end; a gland boss that inserts into the receiving end; an external seal that inserts into the boss and extends axially outward from the receiving end; and a grounding assembly disposed between the internal and external seals.

The assembly includes an adapter for providing electrical grounding contact between the cable and the swage tube; a space-retainer for structurally supporting the adapter; and a washer for axially separating the internal and external seals. Various exemplary embodiments provide the adapter for electrically connecting an interior surface of a conduit and an external surface of a cable. The adapter includes an electrically conductive and mechanically flexible sheet having first and second edges that can face each other, the sheet being configured to form an annulus that mechanically contacts the external surface of the cable and a periphery that mechanically contacts the inner surface of the conduit.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Various exemplary embodiments related to the invention were developed for the purposes of providing a Cable Shield Ground Adapter (CSGA) with the following characteristics important for use in marine environments and in particular shipboard environments:

Environmental sealing from both interior and exterior weather environments.

Universal Adaptive electrical grounding contact for all sizes of cable or conduit applicable to the maximum interior dimensions of a swage tube whether metric or SAE.

Universal Adaptive electrical grounding contact for minor variances in the interior diameter of swage (stuffing) tubes due to SAE or metric sizing.

Better areal contact with the cable shield and inner wall of swage tube.

Better physical tolerance from pulling or distortion of cable and conduit.

Simplicity of design.

Simplicity of installation, repair and replacement.

At sea component replacement.

Longer lifetime of grounding components.

Ability to use broad selection of conductive materials.

Reduced waste of component materials of common swage tubes.

Reduced cost of installation and repair.

Three potential designs for CSGAs have been developed with maritime utility and exposure to the marine environment as a design driver. These can be notionally referred to as "snowflake", "roll-o-dex" and "lantern" for purposes of description. Each of these embodiments incorporates a unique deformable conductive diaphragm as the principle component with additional ancillary components common to all three designs. These ancillary components provide for stability during deformation and environmental sealing along with strain relief.

Figure 1:
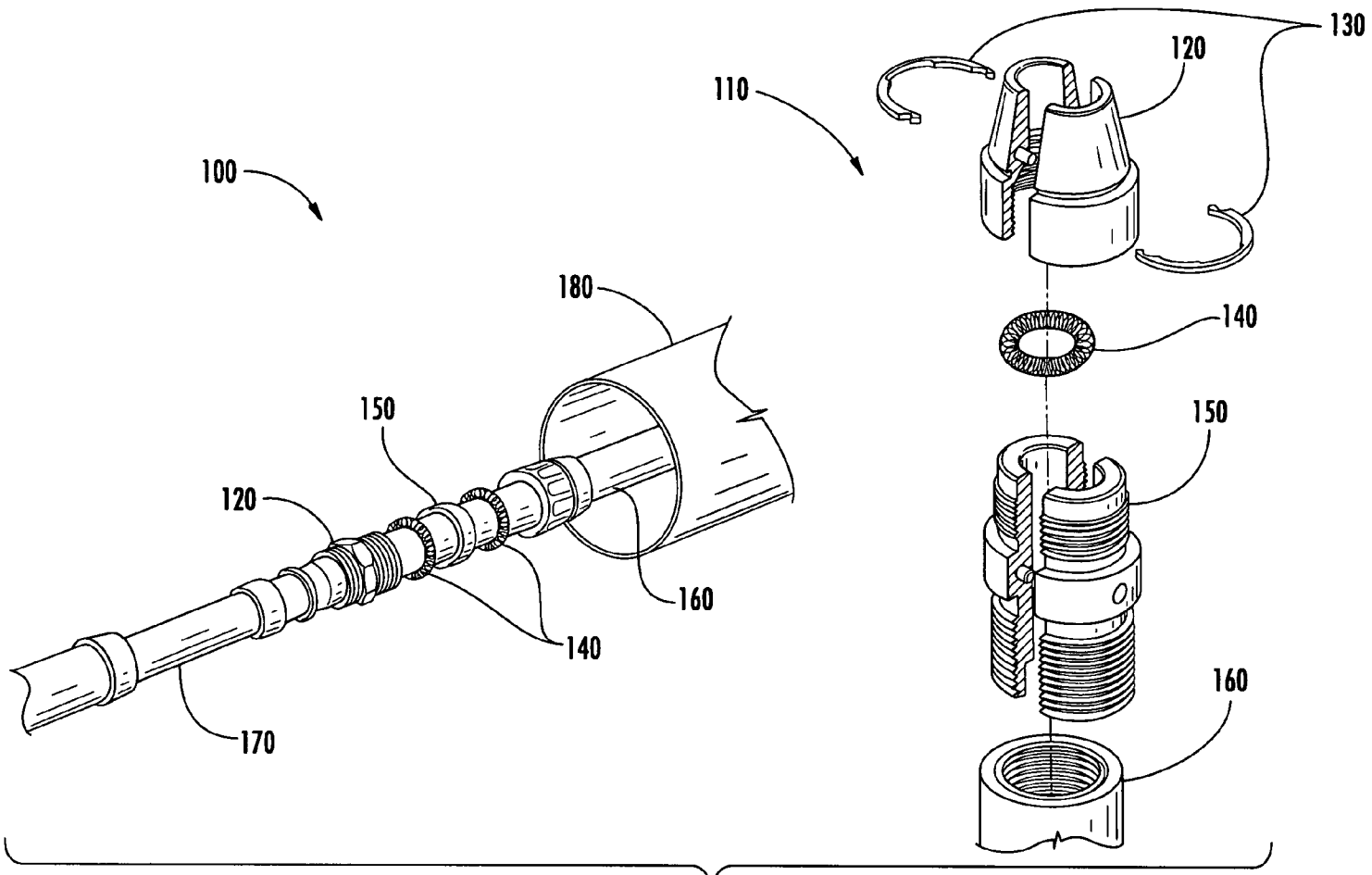
FIG. 1 is a perspective view of a first conventional ground adapter assembly, and exploded portions of a repair kit assembly.

FIG. 1 shows a perspective assembly view 100 of the conventional Glenair® adapter and a perspective exploded view 110 of its associated adapter repair kit. A cap 120 subdivides into a pair of interconnecting halves held together by interlocking retaining ring halves 130. At least one spring assembly 140 separates the cap 120 from an adapter 150, also divided into a pair of interconnecting halves that when assembled screw into a threaded stuffing tube 160. A cable 170 inserts within the cap 120 and the adapter 150, all of which are surrounded by an environmental conduit tube 180.

Figure 2:
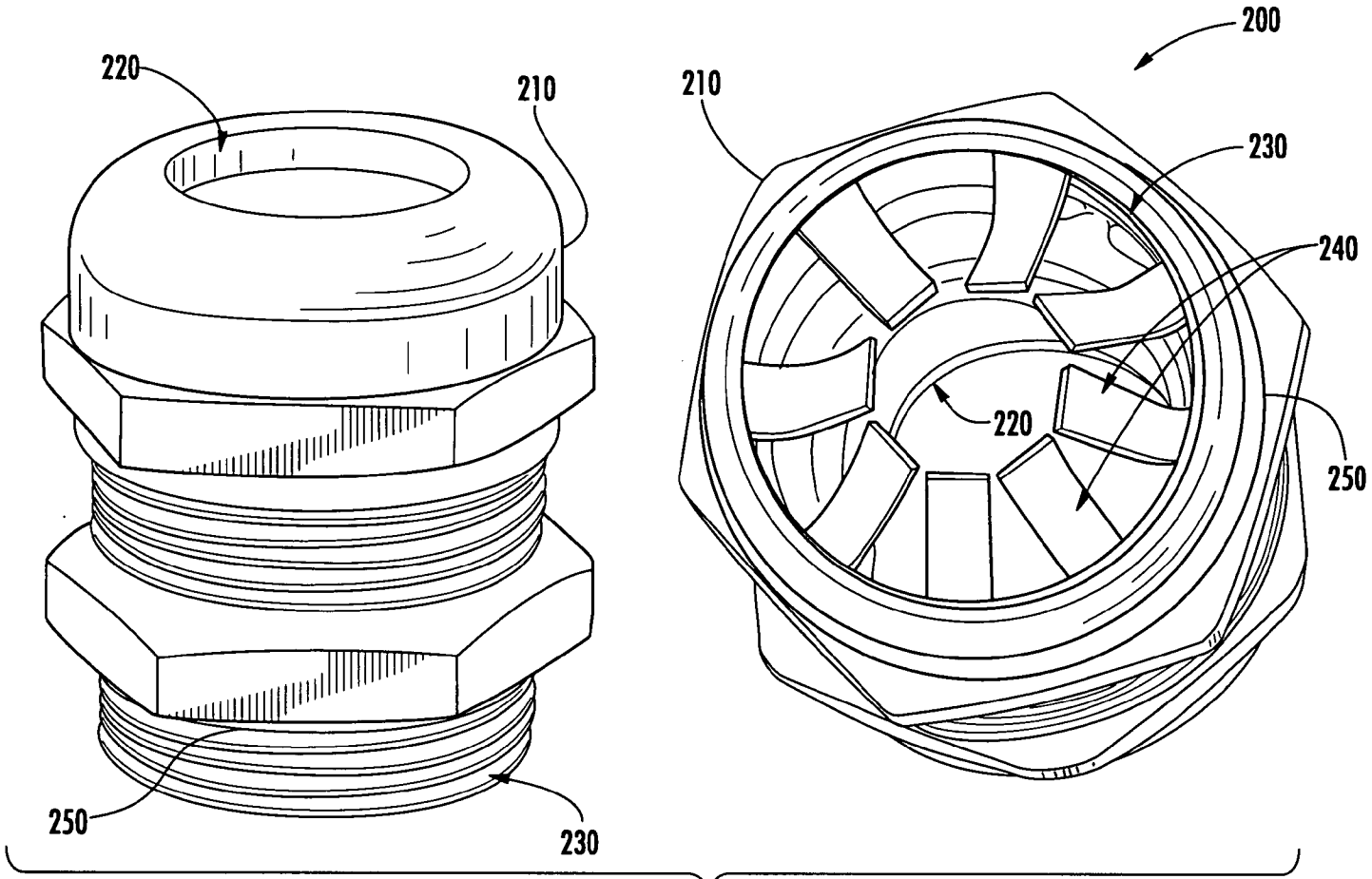
FIG. 2 is a perspective view of a second conventional ground adapter from two positions.

FIG. 2 shows a perspective exploded view 200 of the conventional SkinTop® adapter 210, having a fore aperture 220 and an aft aperture 230, the latter including electrically conductive tabs 240 that extend radially inward towards the axial centerline to ground the cable 170. An O-ring 250 provides sealant between the hexagonal gland and the stuffing tube 160.

Figure 3:
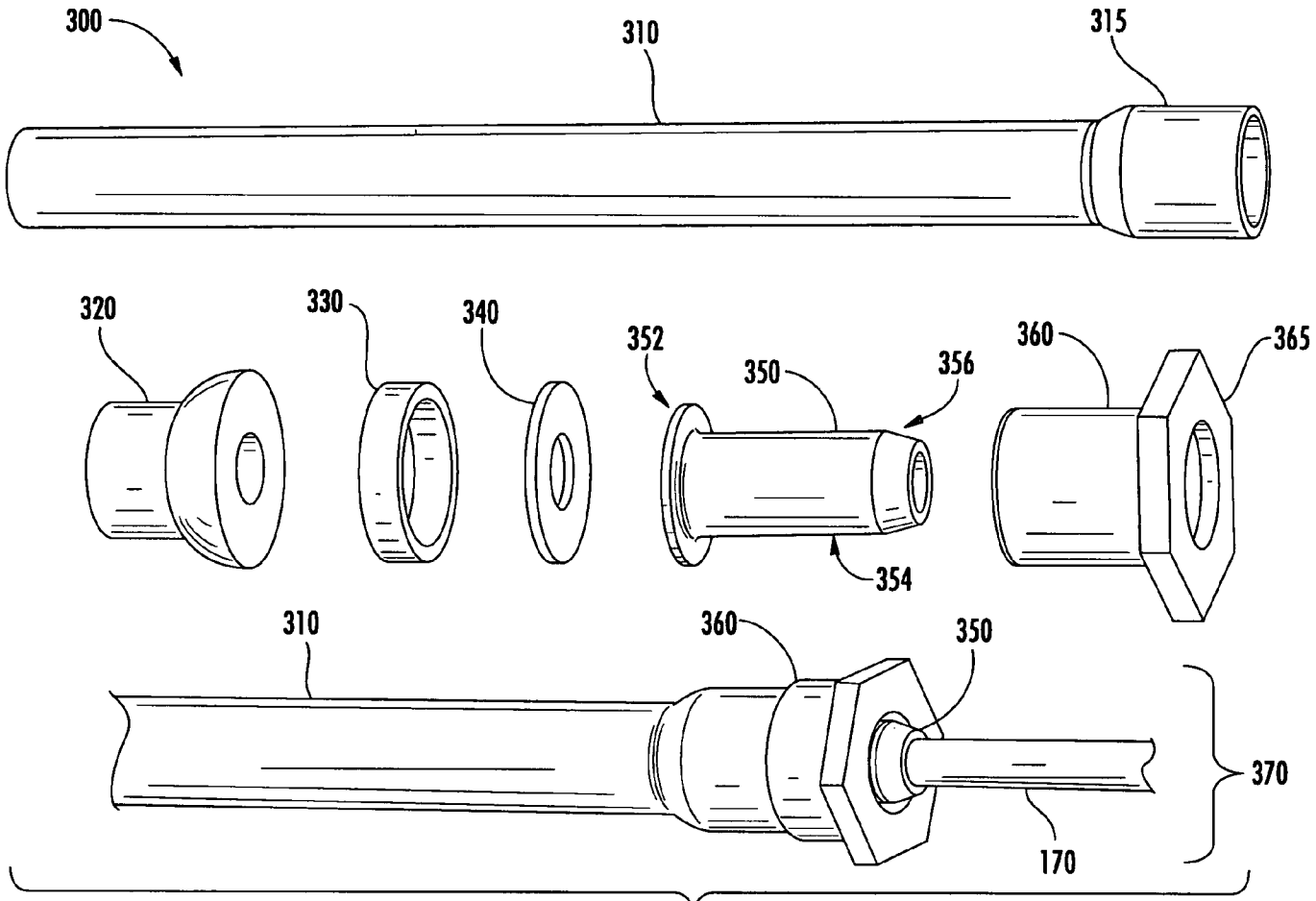
FIG. 3 is an isometric exploded view of components related to cable interface.

FIG. 3 shows an isometric exploded view 300 of components associated with the cable interfaces. A stuffing or swage tube 310 includes an expanded bowl end 315 with interior screw-thread. The items inserted into this end 315 for grounding the cable 170 include an internal environmental seal 320, at least one conductive spacer or retainer 330, at least one stabilizing washer 340, an external environmental seal 350 that includes a flare 352, a body 354 and a tip 356, and a gland nut 360 that terminates with a hexagonal fitting 365. Sealing can be achieved by frictional interference, so as to obviate the necessity of helical thread interfaces.

Various exemplary embodiments as described by the proposed designs described as follows overcome all of the design shortcomings of the above listed conventional designs. The exemplary CSGA embodiments are each adaptable to both variances in cable size as well as variances in swage tube diameters using a bidirectional deformable contact design not incorporated in either of the above examples. For example, the "snowflake" diaphragm is designed with peripheral flexible contact fingers along the entire circumference of the diaphragm. This feature is not found in any other known design.

Each of the three embodiments utilize the gland nut 360 supplied with the swage tube 310 to lock components in place and therefore thread size issues common to both the above listed alternatives can be completely avoided so as to enable universal use of the proposed adapters. Each embodiment incorporates ancillary components that can be reused during repair and replacement of the grounding diaphragm and should last the life of the platform with only maintenance needed during refit periods. The grounding diaphragm is designed to be easily repaired in situ with removal and replacement of same type diaphragm components as used in initial installations. Additionally, fitted gaskets are provided for both exterior and interior water intrusion protection with the inner gasket serving as a stabilizing base for the deformable diaphragm.

All three embodiments employ standard components that include the stuffing or swage tube 310, the gland nut 360 that accompanies the swage tube 310 from the manufacturer, the exterior environmental seal 350, the stabilizing washer 340, the conductive retainer 330, and the internal seal 320. The following is a description of each common component followed by a description of the unique components of each design. In particular, conventional arrangements do not incorporate the internal seal 320.

The swage tube 310 is a flared section of pipe made of an electrically conductive material such as steel or aluminum that provides for a grounded penetration through a wall or bulkhead. These components are generally circumferentially welded to the bulkhead but can be threaded under certain circumstances. The purpose of this component is to provide an access point through the bulkhead for the transiting cable 170.

The gland nut 360 is a component provided by the manufacturer to cap the end of the swage tube 310. These nuts are typically machined from brass to the proper diameter and exterior screw-thread (example shown in FIG. 36) to ensure a mechanically tight fit with the swage tube 310. Most gland nut 360 types have a port machined into their center to permit a cable 170 to pass through. The gland nut 360 provides centering for the cable 170 immediately entering through the nut 360, but this is not designed to provide either weather sealing or tension relief.

Figure 4:
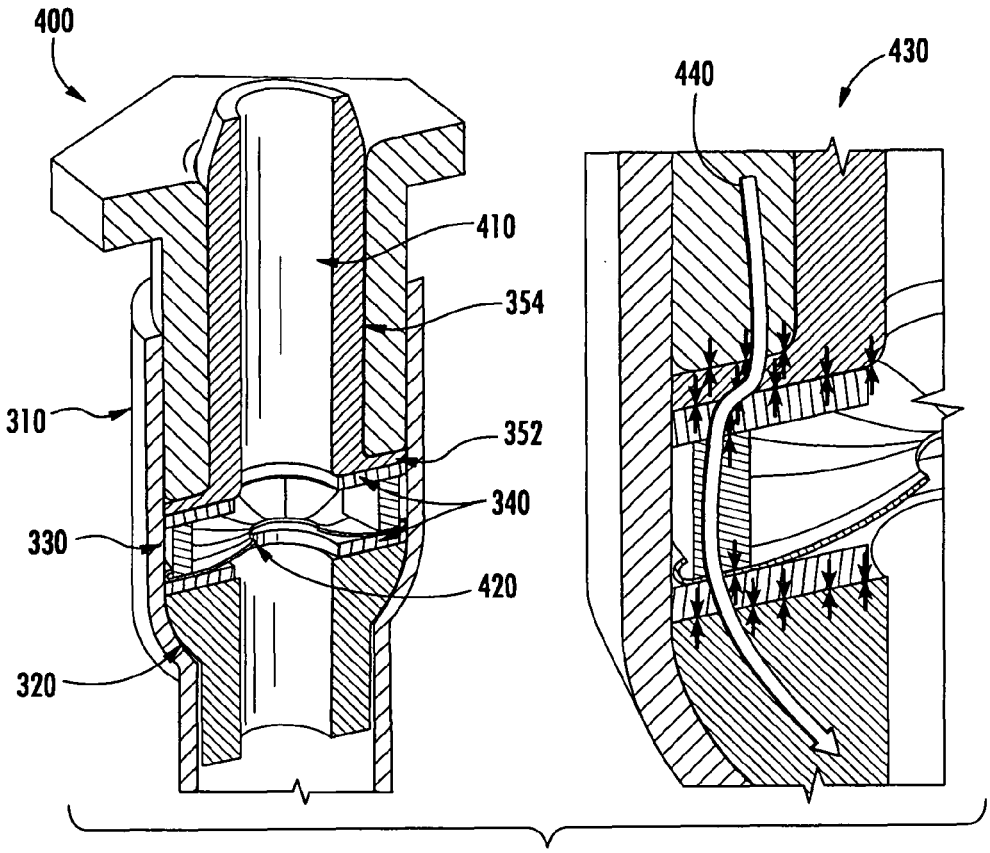
FIG. 4 is a perspective cross-section view of a cable interface assembly, complete and detail.

The exterior environmental seal 350 is employed by each of the designs, which all utilize a hermetic sealing system which also acts as a centering mechanism (as further described in FIG. 5) for the cable 170. The outer diameter of the exterior environmental seal 350 is slightly larger than the inner diameter of the gland nut 360. FIG. 4 shows views of the interface assembly. The complete assembly view 400 shows the sleeve formed by inner annulus of the body 354 of the external seal 350 enveloped by the gland nut 360, and an exemplary generic diaphragm 420 (resembling the "snowflake" embodiment) disposed within the retainer 330 and sandwiched between a pair of washers 340. The gland nut 360 and the interior seal 320 are inserted into the swage tube 310 through the bowl end 315, and the external seal 350 extends from within the gland nut 360. A detail view 430 shows the primary load path 440 imposed by tightening of the gland nut 360 within the swage tube 310. The conductive diaphragm 420 represents exemplary components of which the configuration shown constitutes one example design.

A reaction load due to the compression of the external seal 350 on the inner surface of the gland nut 360 creates a sealing surface thereby preventing leakage. The annular compression of the external seal 350 causes the inner diameter of the external seal 350 to slightly decrease. When there is a cable 170 in the external seal 350, the jacket of the cable 170 compresses by the deformation of the external seal 350, hermetically sealing the region between the cable jacket and inner annulus of the external seal 350. The tip 356 of the external seal 350 is beveled to enable the seal 350 to easily slide into the axial aperture of the gland nut 360. The tip 356 extends slightly above the gland nut 360 to provide tension relief to the cable 170.

The bottom of the seal 350 is flared to form a continuous surface for the gland nut 360 to compress. The flared section 352 of the external seal 350 is filleted to inhibit stress concentrations so as to obviate tearing from pulling the seated cable 170. Once the assembly is installed, the flared section 352 compresses between the gland nut 360 and the stabilizing washer 340. The compressed flared section 352 acts a spring-mass-dampening system to enable the internal structure to be resilient to degradation and fatigue failure, initiated from external vibrations.

At least one stabilizing washer 340, and preferably a pair of these, is also used by all three concepts. The washers 340 have the same inner diameter as the uncompressed external environmental seal 350 and outer diameter as the inner diameter of the swage tube 310. The stabilizing washer 340 performs several functions: such as to reduce the pressure placed on the external and internal environmental seals 350, 320 by the retainer 330. When the gland nut 360 is tightened to seat the system, the load transmits through the external environmental seal 350 to the stabilizing washer 340 through the retainer 330 back through another stabilizing washer 340 and divides into the internal environmental seal 320 and swage tube 310. The curve arrow 440 indicates the general load path. The small downward arrows indicate the applied load from tightening the gland nut 360, and the small upward arrows show the reaction load when the lower seal is pressed inward.

Figure 5:
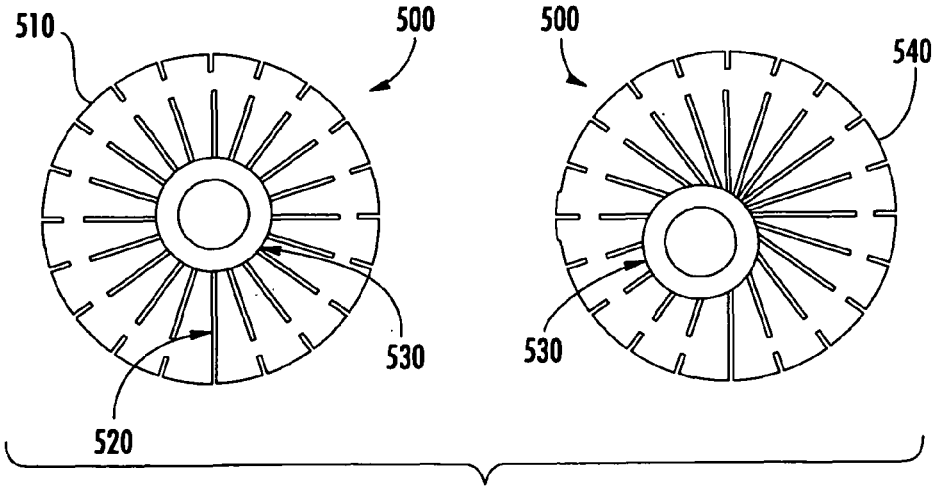
FIG. 5 is a plan view of a cable cross-section within a first "snowflake" exemplary adapter.

Another function of the stabilizing washer 340 is to perform cable centering. FIG. 5 shows a plan view 500 of an exemplary diaphragm, corresponding to the "snowflake" configuration. In particular, the left diaphragm 510 includes a split 520 for wrapping around a tube 530 (corresponding to the cable sheath). The right diaphragm 540 shows the tube 530 canted towards the bottom left side.

The centering feature is critical to the proper function of the various designs and is provided via the stabilizing washers 340, the environmental seals 320, 350 and the gland nut 360. The stabilizing washer 340 and retainer 330 provide a centering load to the cable 170 enabling the diaphragm 420 in any of the three proposed designs to deform in a symmetric way. Absent this centering component, the cable 170 would experience "rolling" within the diaphragm structure leading to incomplete or sub-optimal ohmic contact of the diaphragm with the cable shield. This type of rolling is depicted for the "snowflake" diaphragm design (shown for the tube 530 in FIG. 5 within the opening 630 in FIG. 6).

The retainer or conductive spacer 340 performs three primary functions; it provides for consistent contact pressure between the diaphragm 420, the stabilizing washer 340 and the interior of the swage tube 310 enhancing ohmic response; providing for a minimum component mechanical volume for the diaphragm under deformation providing for optimal structural integrity. The retainer 330 provides for the shaping and controlled deformation of the diaphragm 510 during installation to ensure optimal ohmic contact between the diaphragm 510 and an interior surface 910 in FIG. 9) of the swage tube 310.

The internal environmental seal 320 will compress when coming in contact with the inner surface of the swage tube 310. The compression causes a deformation of the internal environmental seal 320, reducing the inner diameter of the cable opening. A cable 170 that extends within the opening experiences a compressive load, sealing both the interface between the cable 170 and the internal seal 320, and the swage tube 310 and the external seal 350.

Figure 6:
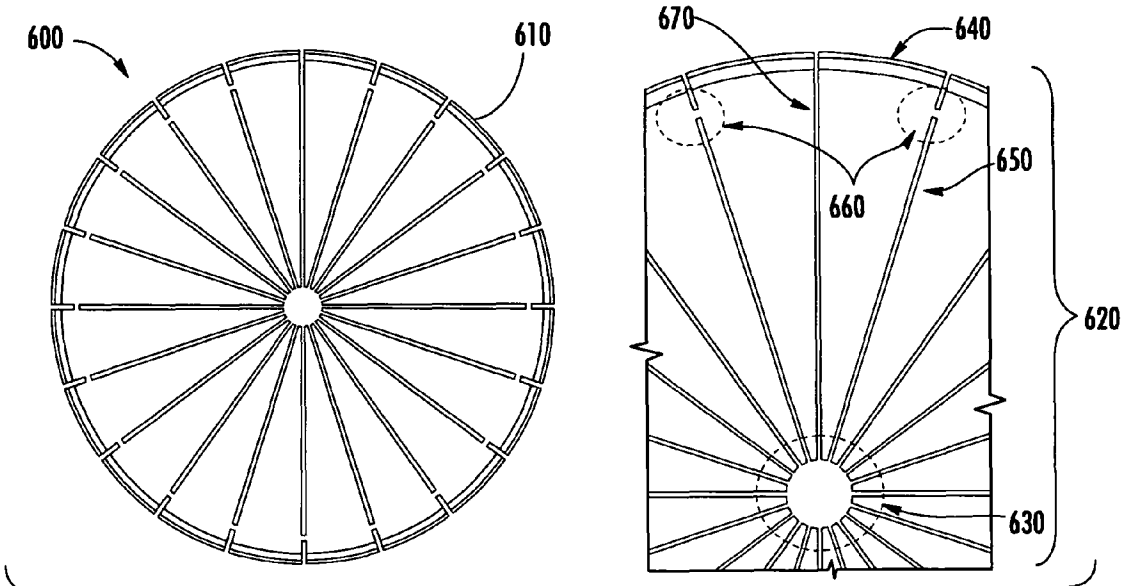
FIG. 6 is a plan view of the first exemplary adapter, complete and detail.

FIG. 6 shows plan complete and detail views 600 of the first "snowflake" embodiment, corresponding to the diaphragm 510 described generally. More specifically, a circular flat-plate adapter 610 includes a detail portion 620 featuring an annular opening 630 and an outer rim 640. Slots 650 extend radially outward from the opening 630 and radially inward from the rim 640, leaving an angular series of gaps 660 to maintain structural unity of the adapter 610. A split 670 extends from the opening 630 to the rim 640 without a gap 660 to enable pulling the portions separated by the split 670 to wrap around the cable 170 without complete disassembly of other components.

Due to the torsional flexibility of the adapter 610, the "snowflake" design can be adapted to a variety of cable sizes. The conventional Skintop® employs a flexible diaphragm similar in concept to the "snowflake" design. Significant physical differences can be noted between the conventional and exemplary "snowflake" designs are manifest in the function of the diaphragms.

The resultant structural loading for the SkinTop® design imposes the requirement of stiffer materials and shorter finger lengths, thereby limiting its range of applicable cable sizes, as compared to the "snowflake" embodiment. The smallest clamping diameter for the "snowflake" design is limited only by the resolution of the stamping and is likely to be less than 0.04 inches and maximum variation is limited by the maximum cable size that can be transited by the swage tube 310. The "snowflake" diaphragm is non-load bearing, this feature being ascribed to different components described in detail below. This enables the "snowflake" to be composed of non-structural materials such as foil laminates and to have finger lengths that extend fully to the center of the diaphragm.

Figure 7:
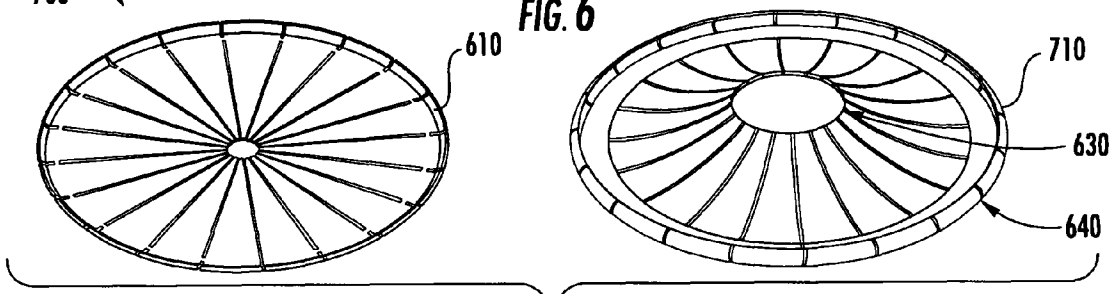
FIG. 7 is a perspective view of the first exemplary adapter, initial and deformed.

FIG. 7 shows perspective initial and deformed views 700 of the first "snowflake" embodiment. The un-deformed adapter 610 prior to installation contrasts with a deformed adaptor 710 having an expanded opening 630 and an inwardly curving rim 640 following standard cable installation.

Figure 8:
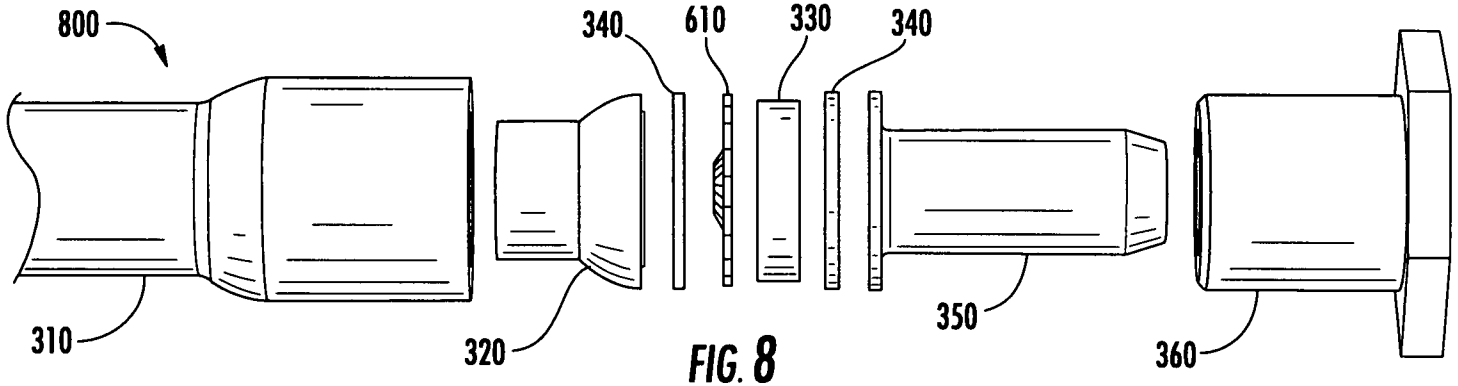
FIG. 8 is an elevation exploded view of cable interface components with the first adapter embodiment.
Figure 9:
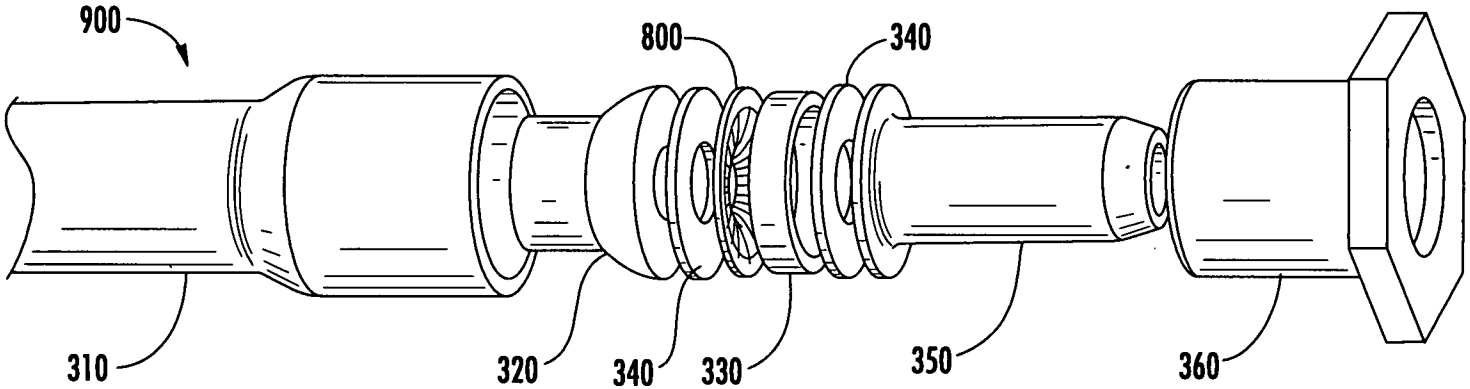
FIG. 9 is a perspective exploded view of cable interface components with the first adapter embodiment.

FIGS. 8 and 9 show respective elevation and perspective exploded views 800 and 900 of components for the cable interface with the first adapter embodiment. The (undeformed) adapter 610 is shown disposed between an aft washer 340 and the retainer 330, although an additional adapter 610 can optionally be disposed between the retainer 330 and a fore washer 340. The interior seal 320 and the swage tube 310 are presented to the left of the aft washer 340, and the external seal 350 and the gland nut 360 are presented to the right of the fore washer 340. The perspective view 900 denotes an inner wall 910 of the swage tube 310 for reference purposes.

Figure 10:
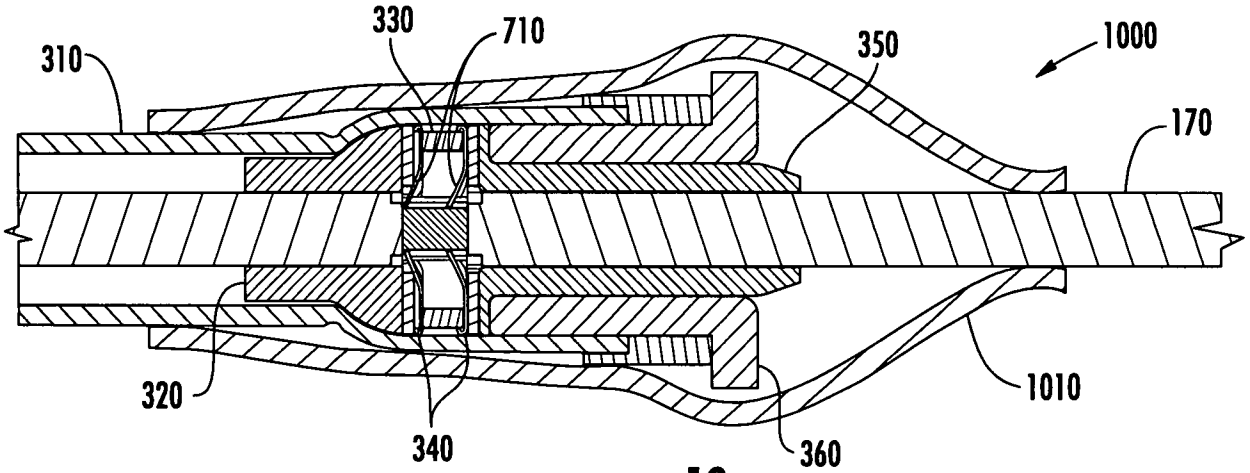
FIG. 10 is an elevation cross-section assembly view of cable interface components with the first adapter embodiment in a mirrored configuration.
Figure 11:
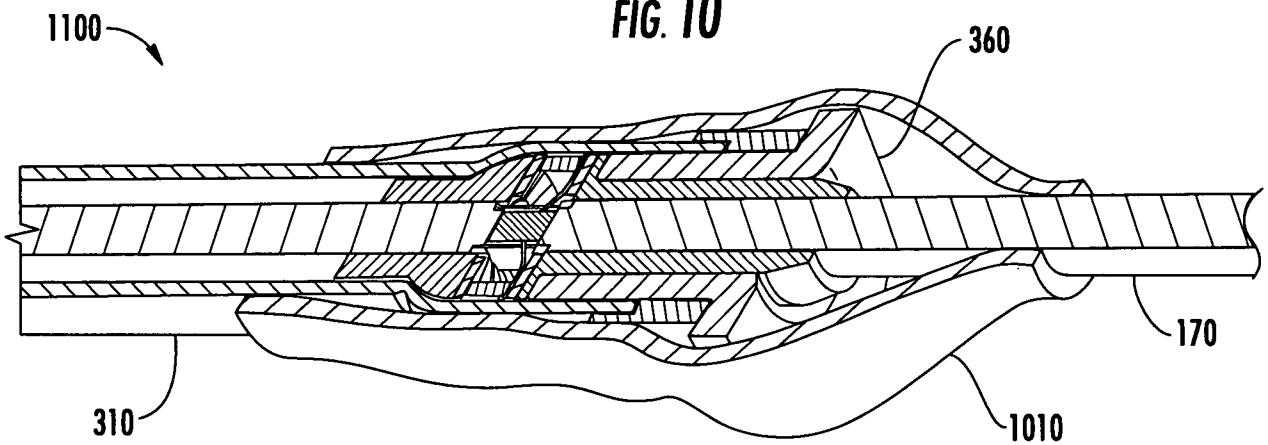
FIG. 11 is a perspective cross-section assembly view of cable interface components with the first adapter embodiment in a mirrored configuration.

FIG. 10 shows an elevation assembly cross-section view 1000 of the cable interface with the first adapter embodiment. A pair of adaptors 710 (deformed) contact the cable 170 within the interface assembly between the two washers 340 separated by the retainer 330, the washers 340 being flanked by the interior and exterior seals 320, 350. The assembly is covered by an environmental jacket 1010 for protection from atmospheric elements. FIG. 11 shows a perspective assembly cross-section view 1100 of the cable interface with the first adapter embodiment.

For the first or "snowflake" embodiment, the design unique component is the conductive diaphragm or adapter 610, which operates in conjunction with the retainer 330. The adapter 610 constitutes an electrically conductive circular disc. The radial slots 650 starting from the center 630 of the adapter 610 and extending outwards toward the circular periphery or rim 640. These form the flexible fingers that slide over the shield of a cable 170. There are also shorter conductive fingers on the perimeter of the diaphragm to enable the adapter 610 to deform and fit snugly into the swage tube 310 despite mild variation in the tube diameter providing optimal ohmic contact with the inner surface (910) of the swage tube 310.

Because the diaphragm 510 is non-load bearing, this component can be made from a variety of very thin materials, so long as the material's elastic deformation range is adequate to support the installed component (under load) without yielding to plastic deformation, and possesses electrically conductive characteristics. Foil covered plastic sheets could be used in this particular design. This design characteristic renders the "snowflake" and the other embodiments unique.

A second design feature of the "snowflake" design is the utilization of a split-ring topography. The split 670 enables the (deformed) adapter 710 to be removed or replaced after a cable 170 has been terminated to the equipment interface.

This is a unique feature of all three designs, implemented in consideration of the difficulty and considerable cost of repairing a cable shield ground adapter on an installed system. This design feature is not found in any conventional configuration.

A third feature of the "snowflake" design is the ability to stack multiple adapters 710 within the swage tube 310, further enhancing the ohmic path from the cable shield to the inner surface (910) of the swage tube 310. With each doubling in the number of adapters 710 in the stack, the ohmic path reduces by the same factor. The stacking could be arranged on either side of the conductive retainer 340 or with adapters 710 in direct contact, such as a stack of coins.

The spacer or retainer 330 may serve two purposes. The retainer 330 mechanically responds to form a load path to transmit the compressive force developed by the tightening of the gland nut 360. The distribution of force over the diaphragm's periphery 640 helps seat the diaphragm 510 within the stuffing tube bowl 315 ensuring optimal ohmic contact between the diaphragm 510 and the inner wall 910 of the swage tube 310. The second purpose of the retainer 330 is to reduce the ohmic path to the swage tube 310, by providing a larger contact area.

Figure 12:
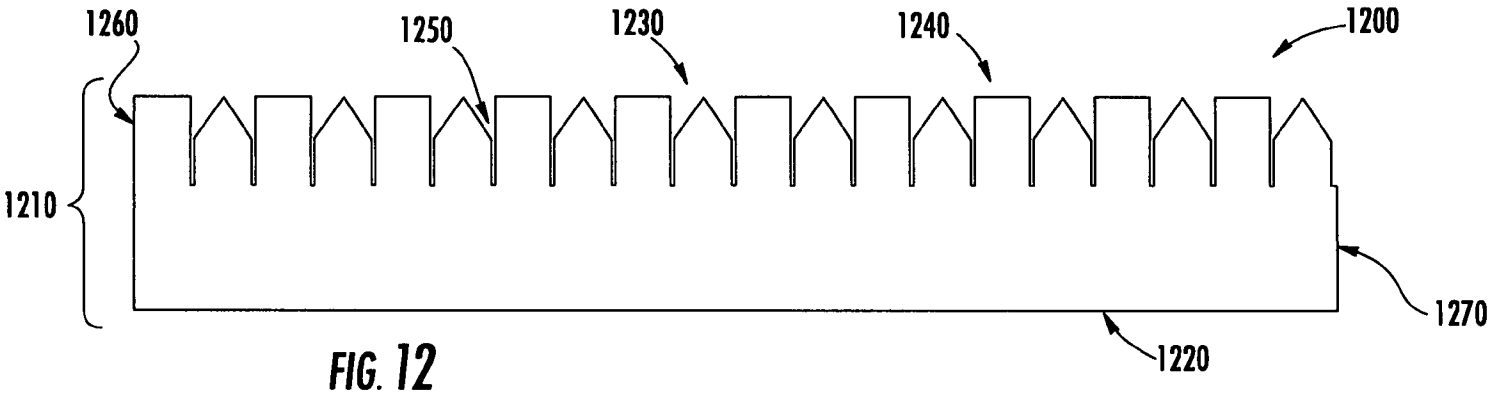
FIG. 12 is a plan view of a template for a second "roll-o-dex" embodiment.

FIG. 12 shows a plan view 1200 of a template for a second "roll-o-dex" embodiment. A thin strip 1210 of metal foil or other electrically conductive and ductile material includes a continuous ribbon 1220 along one side, and along the opposite side an interleaving series of isosceles-end tabs 1230 and flat-end tabs 1240 separated by traverse cuts 1250. The strip 1210 terminates at first and second ends 1260 and 1270.

Figure 14:
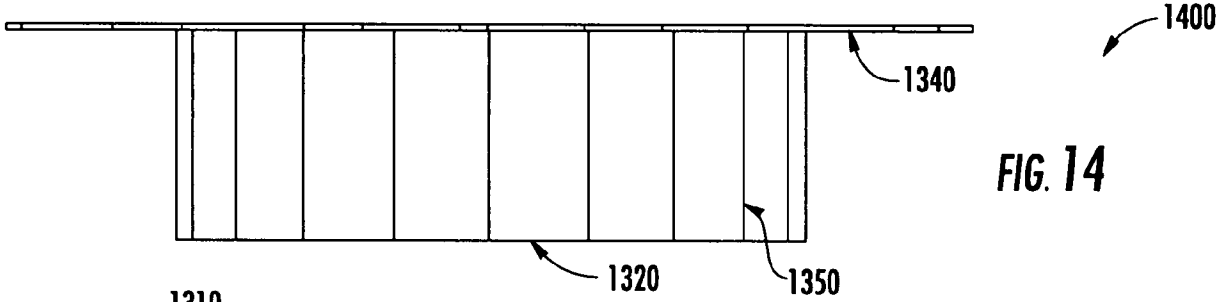
FIG. 14 is an elevation view of the second embodiment adapter.
Figure 15:
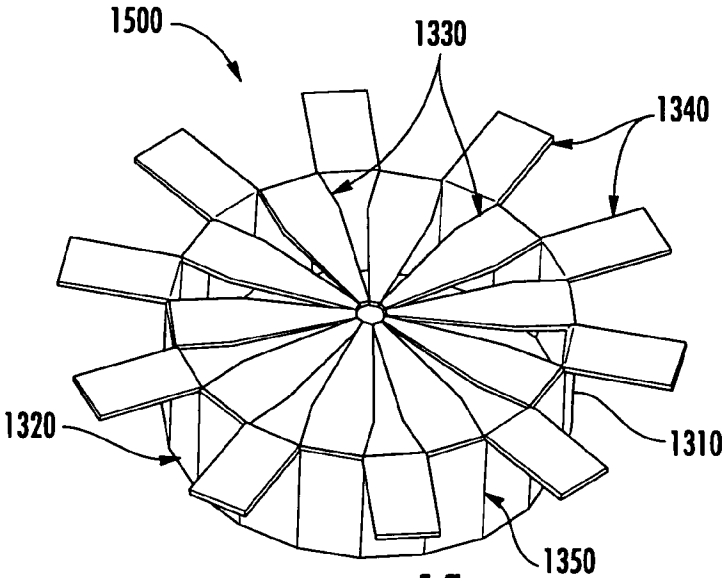
FIG. 15 is a perspective view of the second embodiment adapter.
Figure 13:
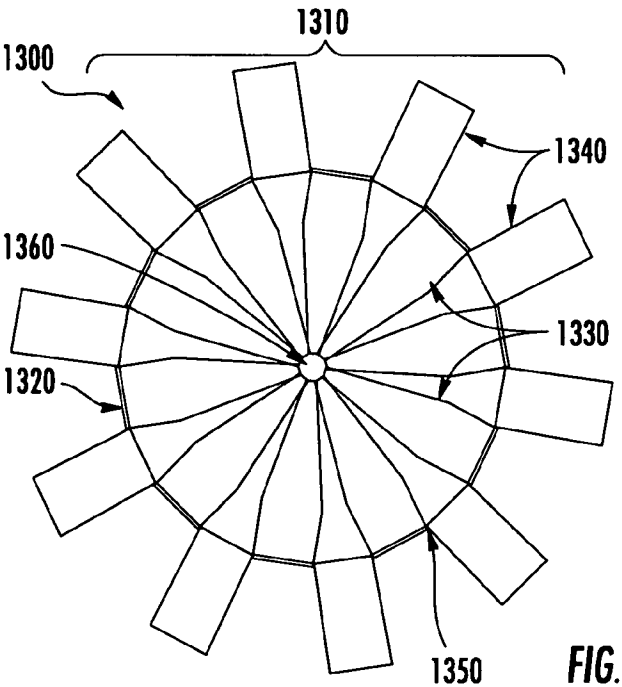
FIG. 13 is a plan view of an adapter constructed from the second embodiment template.

FIG. 13 shows a plan view 1300 of an assembled form of the second "roll-o-dex" embodiment. The strip 1210 can be rolled or bent to connect the ends 1260, 1270 substantially together to form an axi-symmetric cylindrical adapter 1310, with the ribbon 1220 forming a base ring 1320. The isosceles tabs 1230 can be folded radially inward as pointed tabs 1330. The flat tabs 1240 can be folded radially outward as finger tabs 1340. The ends 1260 and 1270 join together at a common edge 1350, providing the split-ring topography for assembly and disassembly. The pointed tabs 1330 form a center orifice 1360 within which the cable 170 can be fitted. FIGS. 14 and 15 show respective elevation and perspective views 1400 and 1500 of the assembled adapter 1310 of the second "roll-o-dex" embodiment.

Figure 16:
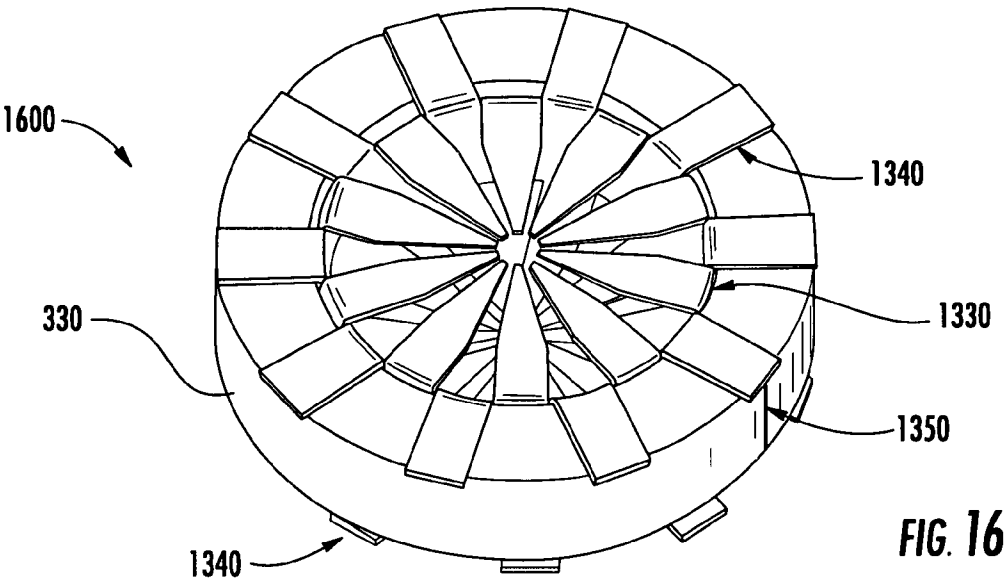
FIG. 16 is a perspective assembly view of a retainer with upper and lower second embodiment adapters.

FIG. 16 shows a perspective view 1600 of a retainer 330 with a pair of installed adapters 1310 of the second "roll-o-dex" embodiment. The upper and lower adapters 1310 are disposed with their folded tabs 1330 and 1340 disposed respectively above and below the retainer 330, and their rings 1320 both within the annulus of the retainer 330.

Figure 17:
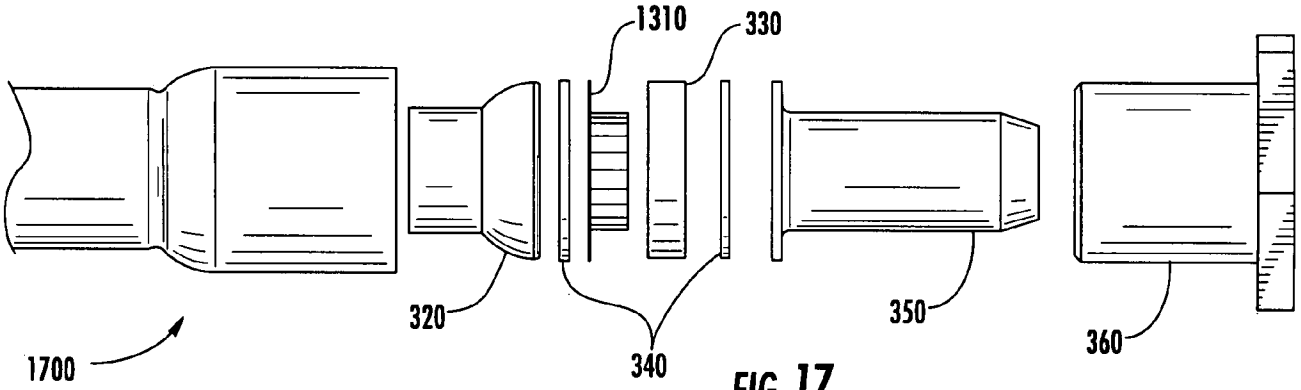
FIG. 17 is an elevation exploded view of cable interface components with the second adapter embodiment.
Figure 18:
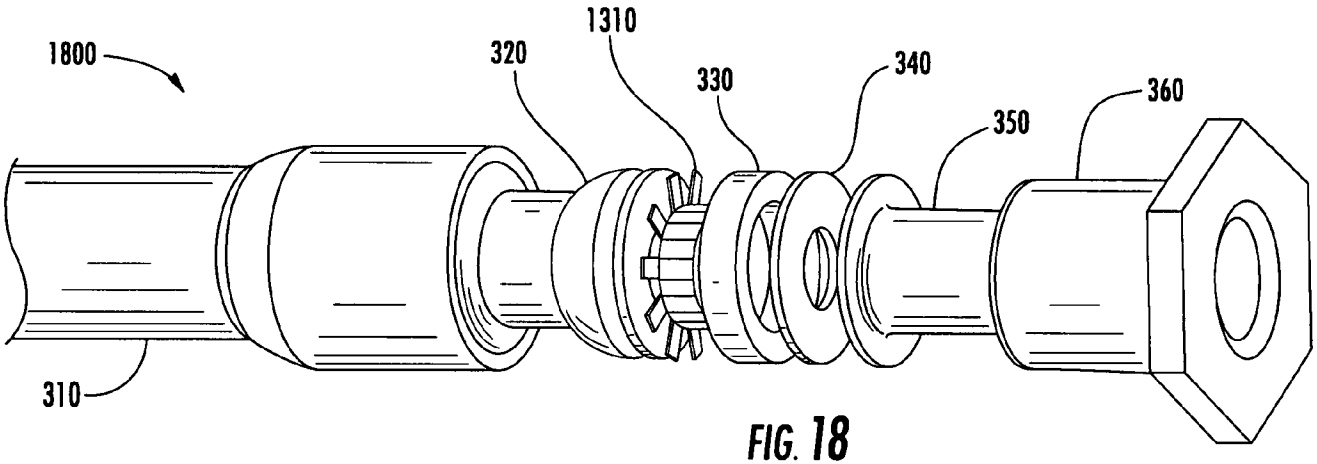
FIG. 18 is a perspective exploded view of cable interface components with the second adapter embodiment.

FIGS. 17 and 18 show respective elevation and perspective exploded views 1700 and 1800 of components for the cable interface with the second adapter embodiment. The adapter 1310 is shown disposed between an aft washer 340 and the retainer 330. The interior seal 320 and the swage tube 310 are presented to the left of the aft washer 340, and the external seal 350 and the gland nut 360 are presented to the right of the fore washer 340.

Figure 19:
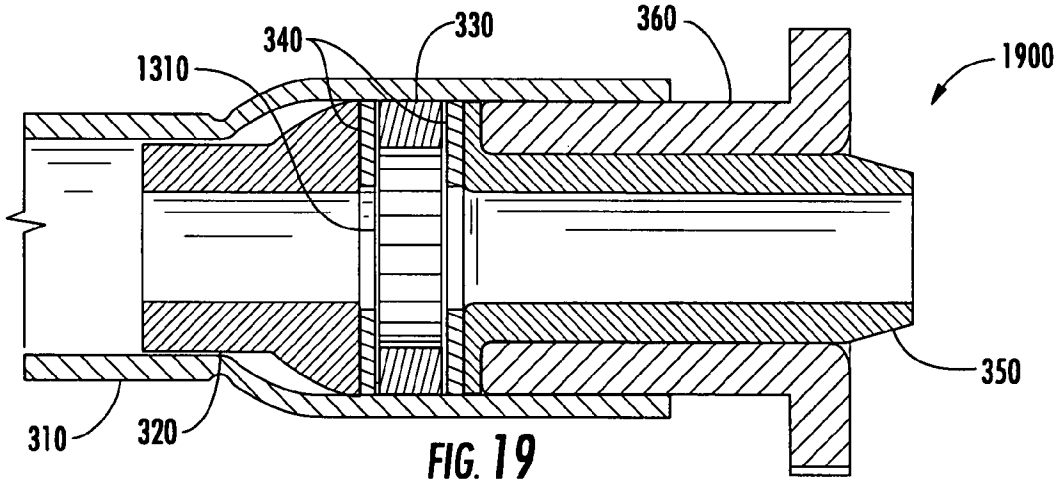
FIG. 19 is an elevation cross-section assembly view of cable interface components with the second adapter embodiment.
Figure 20:
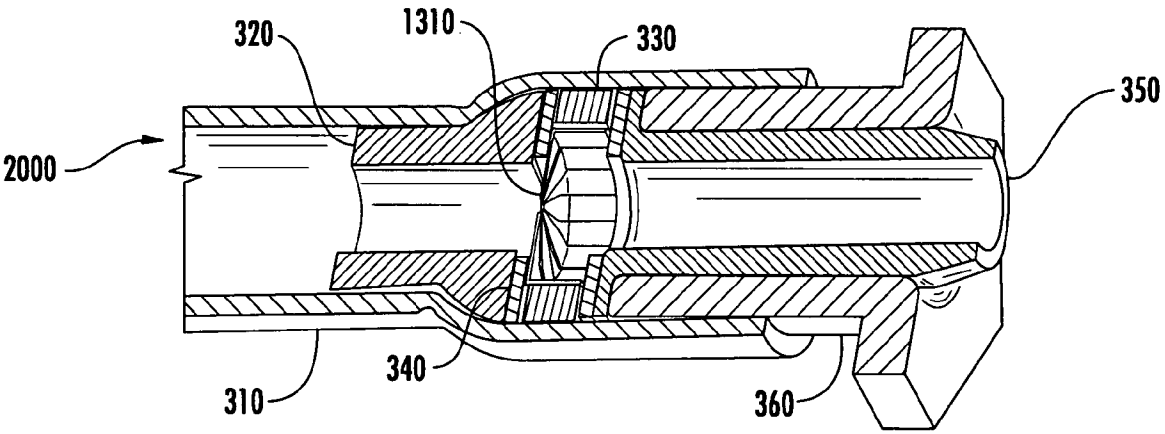
FIG. 20 is a perspective cross-section assembly view of cable interface components with the second adapter embodiment.

FIGS. 19 and 20 show respective elevation and perspective assembly cross-section views 1900 and 2000 of the cable interface with the second adapter embodiment. An adaptor 1310 contacts the cable 170 within the interface assembly between the two washers 340 separated by the retainer 330, the washers 340 being flanked by the interior and exterior seals 320, 350. The environmental jacket 1010 can also be employed assembly for protection from atmospheric elements.

For the second embodiment, the unique component of the "roll-o-dex" design is the electrically conductive adapter 1310, being constructed from a single piece of conductive material. The adapter 1310 is not load-bearing, and therefore a thin conductive material can be used for its construction. The tabs 1330 and 1340 are bent in alternating opposing directions, being repeated for all tabs. The "roll-o-dex" adapter 1310 is designed to elastically deform into an annular shape with the pointed tabs 1330 facing toward the central axis cavity 1360 of the roll. The adapter 1310 can be placed inside the retainer 330 and unfurl thereby securing itself inside the retainer 330. The unique feature of the "roll-o-dex" design is that the adapter 1310 can be stacked as a doublet using the retainer 330 to hold the pair in place. This increases the surface contact area between the adapter 1310 and the interior surface 910 of the swage tube 310, thereby providing an enhanced ohmic grounding path.

The outer flexible finger tabs 1340 (in FIG. 13) contact the inner surface 910 of the swage tube 310, thereby providing a good electrical contact, and tolerance to varying sizes of swage tubes 310. The pointed tabs 1330 are plastically deformed orthogonal to the inner surface of the base ring 1320, toward the center region 1360 of the annulus. These pointed tabs 1330 slide on the shielding of the cable 170 providing the electrical contact. The flexible nature of the pointed tabs 1330 enables for the use of cables 170 having varying size diameters.

The conducting retainer 330 serves three functions. First, the retainer 330 acts to form a load path to transmit the compressive force developed by the tightening of the gland nut 360. The distribution of force over the peripheral rim 640 of the diaphragm facilitates seating the adapter 1310 within the stuffing tube bowl 315 ensuring optimal ohmic contact between the (deformed) diaphragm 710 and the inner surface 910 of the swage tube 310.

The second function of the retainer 330 is to hold the "roll-o-dex" adapter 1310 into an annular shape. The foil strip 1210 is rolled into an annular cylindrical adapter 1310 and inserted into the retainer 330. This retainer-adapter sub-assembly is then placed inside of the swage tube 310 through which the cable 170 can be inserted. The third purpose is to reduce the ohmic path to the swage tube 310, by providing a larger contact area.

Figure 21:
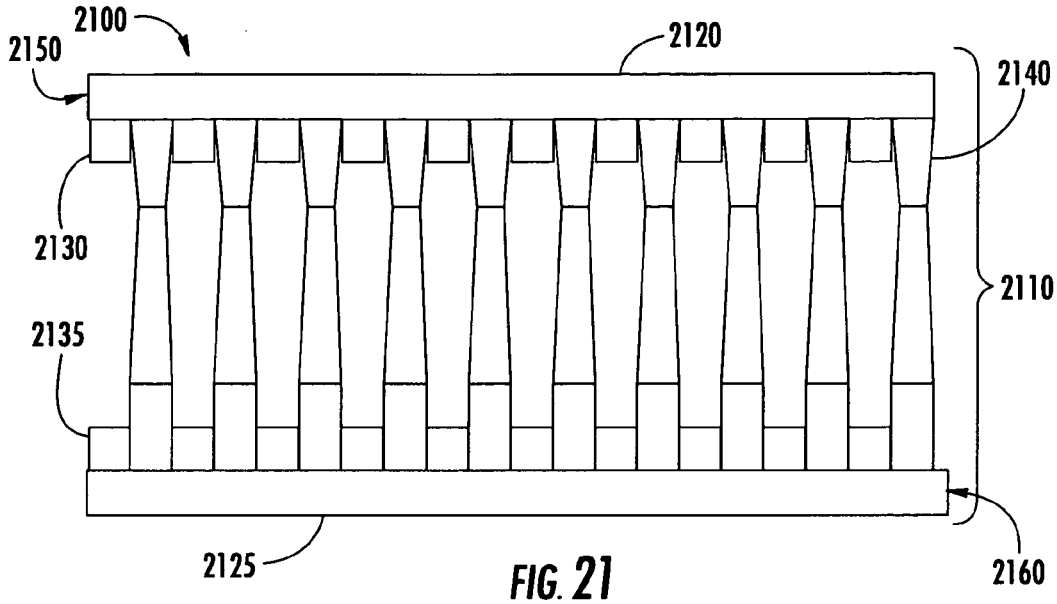
FIG. 21 is a plan view of a template for a third "lantern" embodiment.

FIG. 21 shows a plan view 2100 of a template for a third "lantern" embodiment. A flat strip 2110 of metal foil or other electrically conductive and ductile material includes parallel ribbons 2120 and 2125 separated therebetween by correspondingly facing tabs 2130 and 2135, as well as segmented foldable slats 2140 that connect the ribbons together. The ribbons 2120 and 2125 terminate at first and second ends 2150 and 2160.

Figure 22:
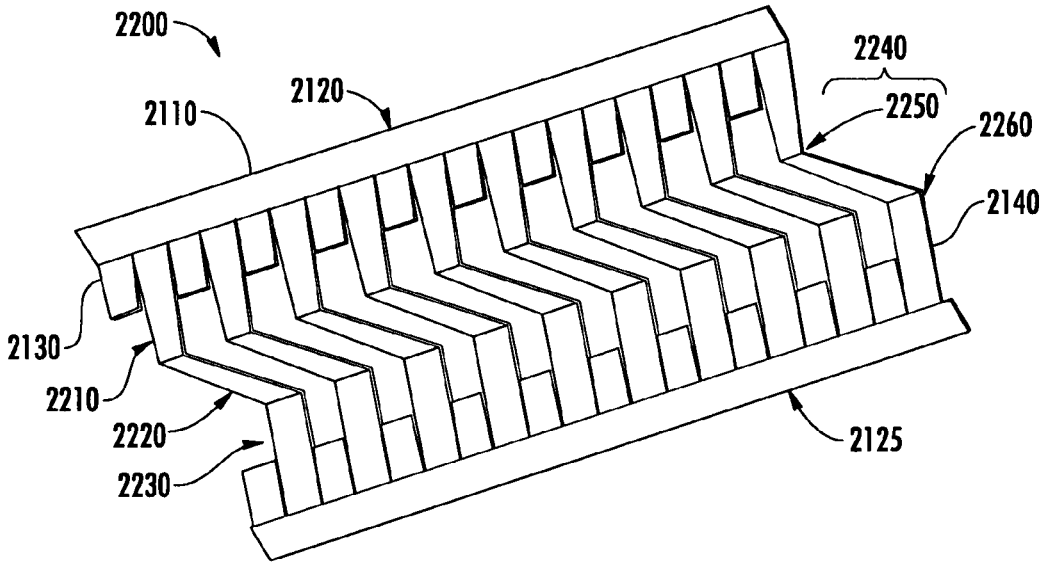
FIG. 22 is a perspective view of the third embodiment template.

FIG. 22 shows a perspective view 2200 of the template for the third "lantern" embodiment. The strip 2110 has been folded so that the slats 2140 can be observed as being subdivided into upper, middle and lower segments 2210, 2220 and 2230, forming a transversely bent region 2240 between folding contact edges 2250 and 2260.

Figure 23:
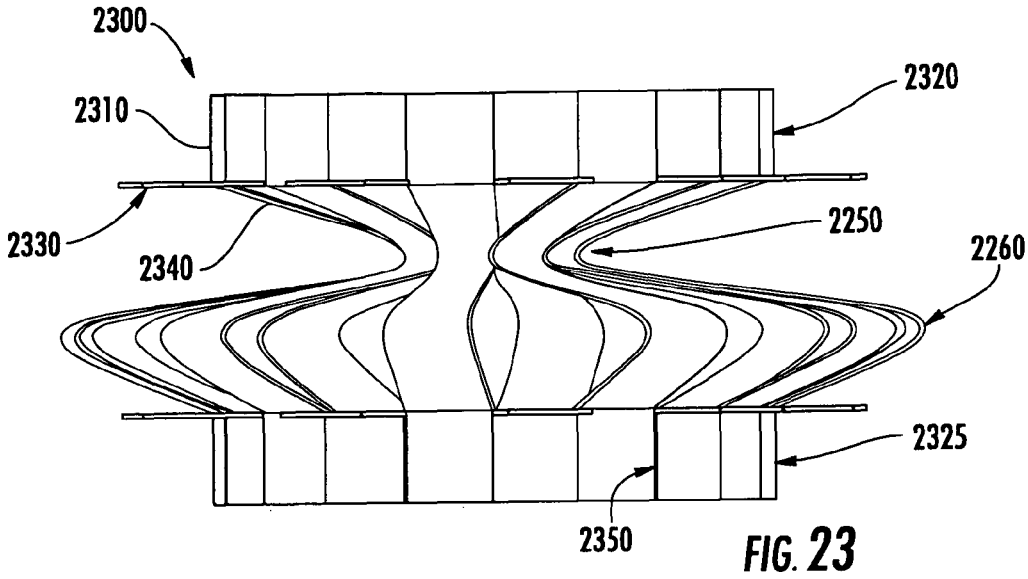
FIG. 23 is an elevation view of an adapter constructed from the third embodiment template.
Figure 25:
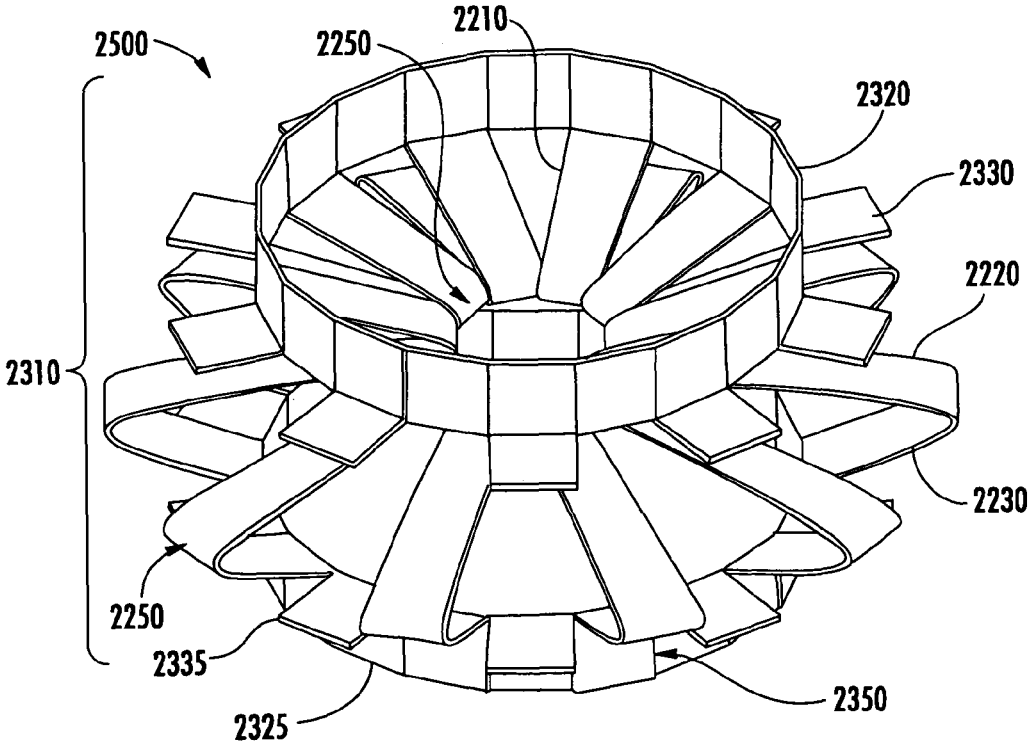
FIG. 25 is a perspective view of the third adapter embodiment.
Figure 24:
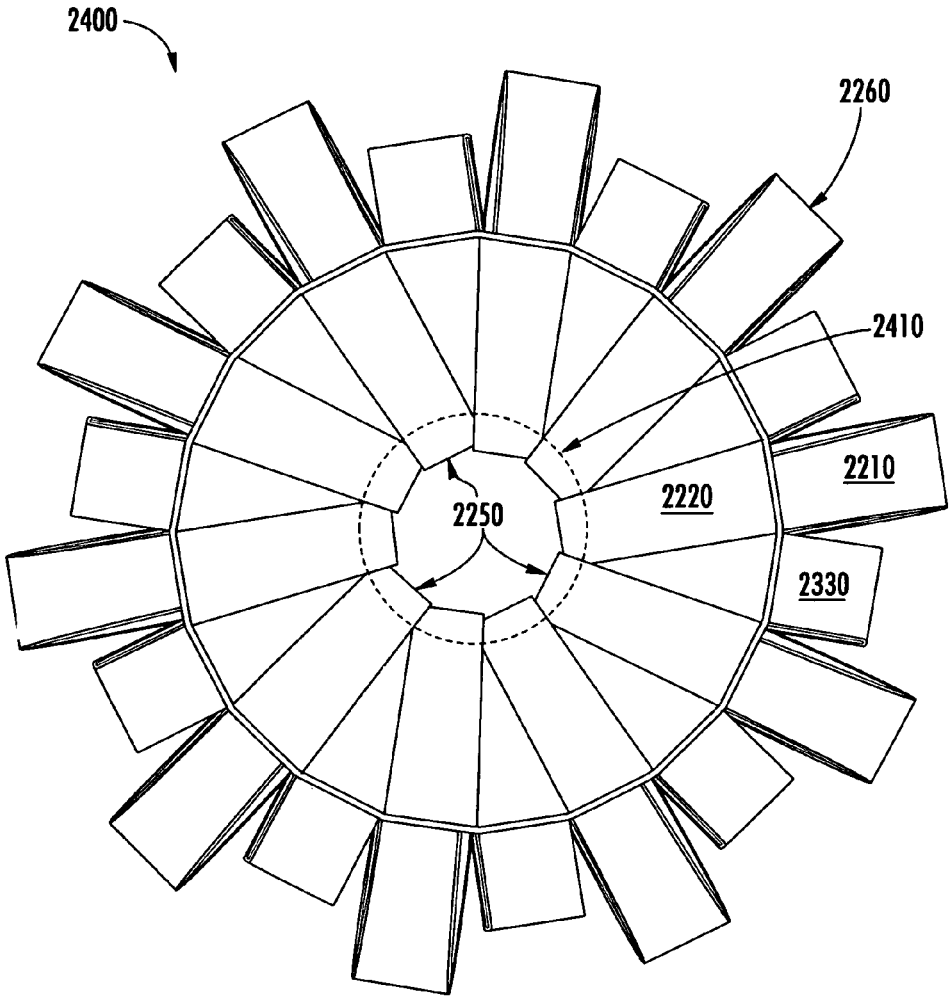
FIG. 24 is a plan view of the third adapter embodiment.

FIG. 23 shows an elevation view 2300 of the assembled third "lantern" embodiment. The strip 2110 can be rolled or bent so that the ends 2150 and 2160 are joined together to form an axi-symmetric adapter 2310. The upper and lower ribbons 2120 and 2125 respectively form corresponding rings 2320 and 2325. The tabs 2130 and 2135 are folded outward to form wings 2320. The slats 2140 are folded to form a concentric pattern of ribs 2340. The ends 2150 and 2160 join to connect at a seam 2350. FIG. 24 shows a plan and perspective view 2400 of the assembled third "lantern" embodiment. The ribs 2340 form an inner annulus 2410 at the edges 2250, and also extend radially outward to edges 2260. Folded outward, the wings 2330 face the cross-sectional surfaces of the retainer 330. FIG. 25 shows the perspective view 2500 the assembled third "lantern" embodiment.

Figure 26:
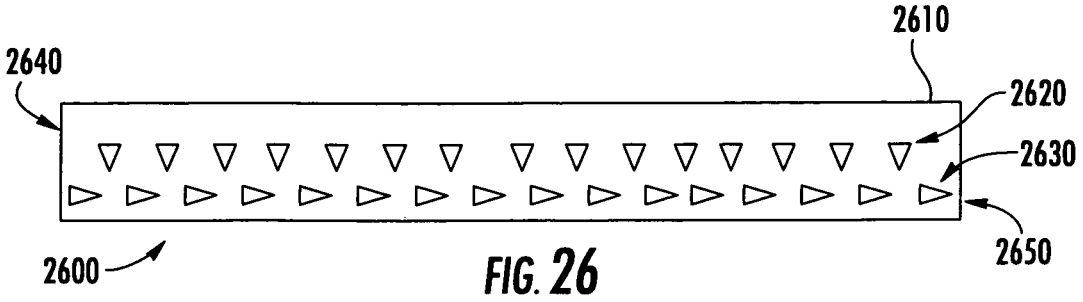
FIG. 26 is a plan view of a cable sleeve for installation with the third adapter embodiment.
Figure 27:
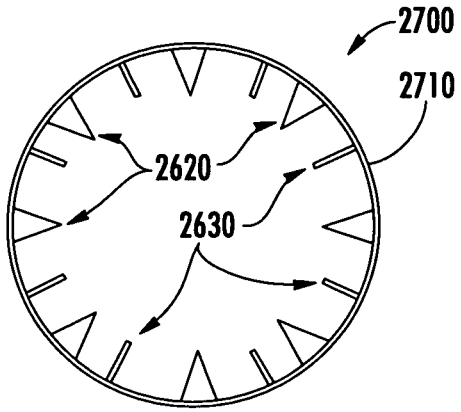
FIG. 27 is a plan view of the sleeve.
Figure 28:
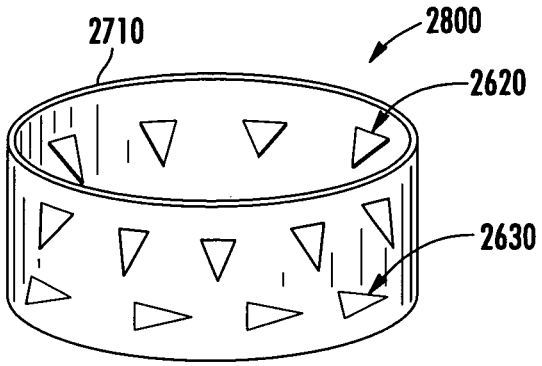
FIG. 28 is a perspective view of the sleeve.

FIG. 26 shows a plan view 2600 of a cable grounding sleeve template. A strip 2610 includes axially and laterally folded teeth 2620 and 2630 distributed evenly thereon along its length, which terminates at ends 2640 and 2650. FIG. 27 shows an elevation view 2700 of grounding sleeve 2710 upon the strip 2610 being rolled together to join the ends 2640 and 2650, thereby unfurling the teeth 2620 and 2630 radially inward so as to penetrate insulative shielding of the cable 170. FIG. 28 shows a perspective view 2800 the grounding sleeve 2710 with the ends 2640 and 2650 joined together.

Figure 29:
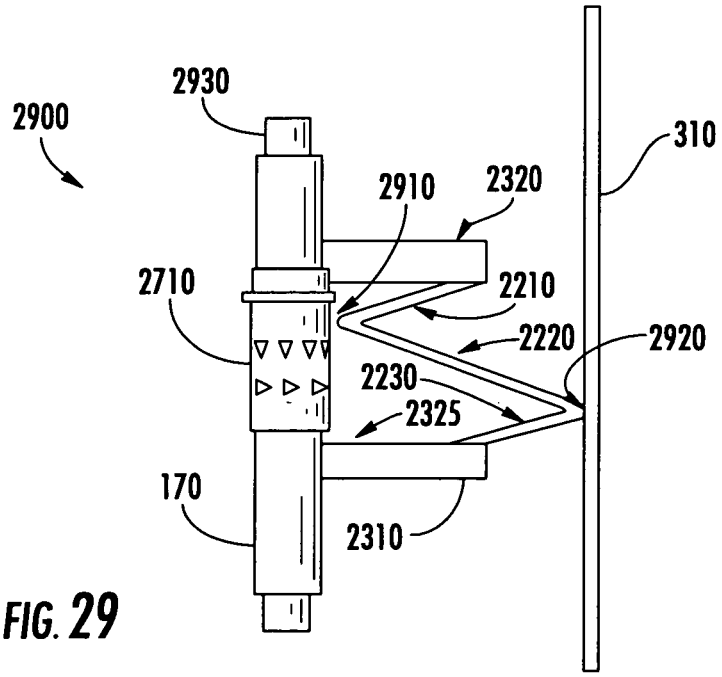
FIG. 29 is a plan view of a cable with the sleeve and the third adapter embodiment installed.

FIG. 29 shows a plan view 2900 of the grounding sleeve 2710 installed with the third adapter embodiment. The adapter 2310 includes prongs 2910 and 2920 attached at the corresponding corners 2250 and 2260 along the ribs 2340 disposed between the rings 2320 and 2325. The contact edges 2250 on the inward prongs 2910 connect the adapter 2310 to the sleeve 2260, whose teeth 2620 and 2630 penetrate the sheath of the cable 170 to reach its conduit shield 2930. The outward contact edges 2260 on the prongs 2920 connect the adapter 2310 to the inner surface 910 of the swage tube 310.

Installation of the grounding sleeve 2710 is accomplished by wrapping the sheet around the circumference of a shielded and jacketed cable 170. The toothed strip 2610 is wrapped Such that the teeth 2620 and 2630 can pierce the cable jacket and form an annulus about the cable 170. The sleeve 2710 is then secured into place either through the use of a crimping tool or a separate retaining ring or strap. That retaining ring can be conductive or non-conductive depending on its size and location relative to the anticipated contact point of the adapter 2310, which can be installed over the sleeve 2710 to complete a grounding path between the conduit shield 2930 and the inner surface 910 of the swage tube 310.

The grounding sleeve 2710 can be easily removed and replaced and provides a method whereby the cable jacket need not be cut to allow the adapter 2310 to gain good ohmic contact with the cable shield. The accidental cutting of the shield through poor installation practices constitutes one of the primary causes of installation related failures. Another cause is poor environmental protection of the cable shield which results in a significant amount of corrosion of the cable shield, which can be obviated by the interior seal 350.

Figure 30:
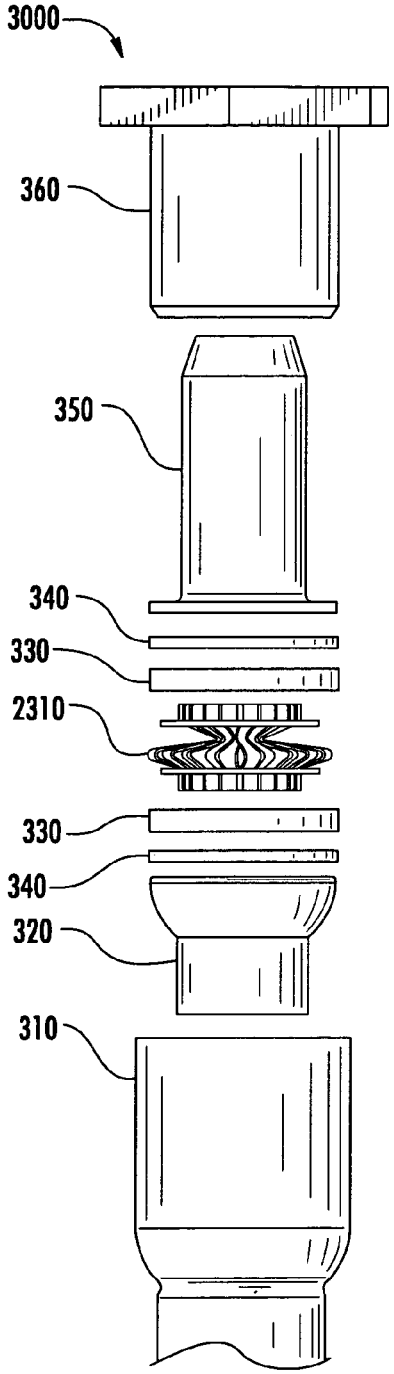
FIG. 30 is an elevation exploded view of cable interface components with the third adapter embodiment.
Figure 31:
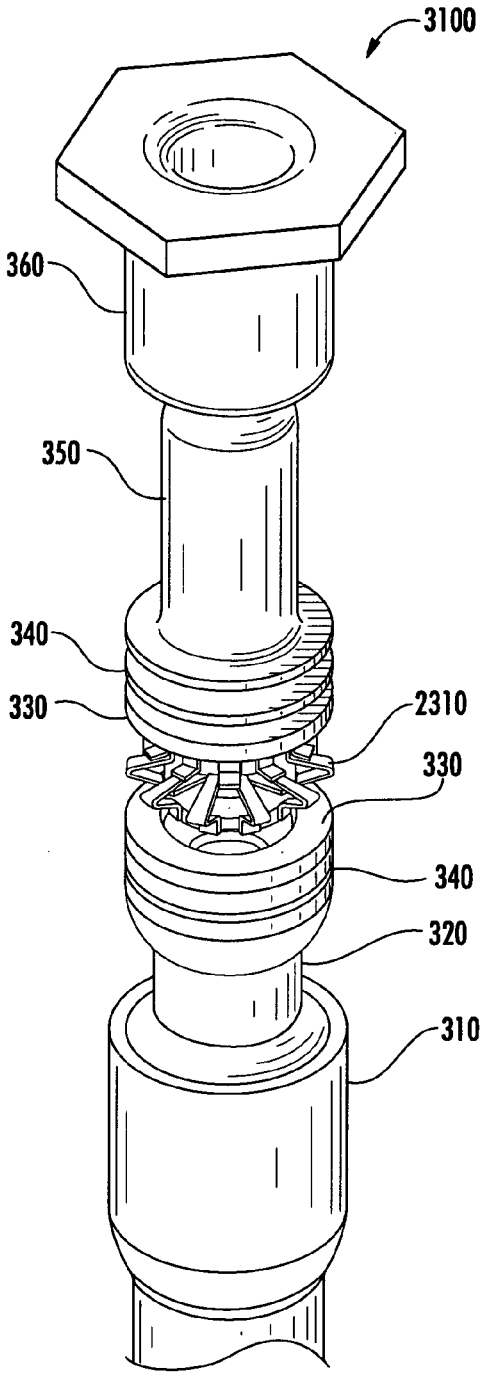
FIG. 31 is a perspective exploded view of cable interface components with the third adapter embodiment.

FIGS. 30 and 31 show respective elevation and perspective exploded views 3000 and 3100 of components for the cable interface with the third adapter embodiment. The adapter 2310 is shown disposed between aft and fore retainers 330, the subassembly being flanked by corresponding aft and fore washers 340. The interior seal 320 and the swage tube 310 are presented below the aft washer 340, and the external seal 350 and the gland nut 360 are presented above the fore washer 340.

Figure 32:
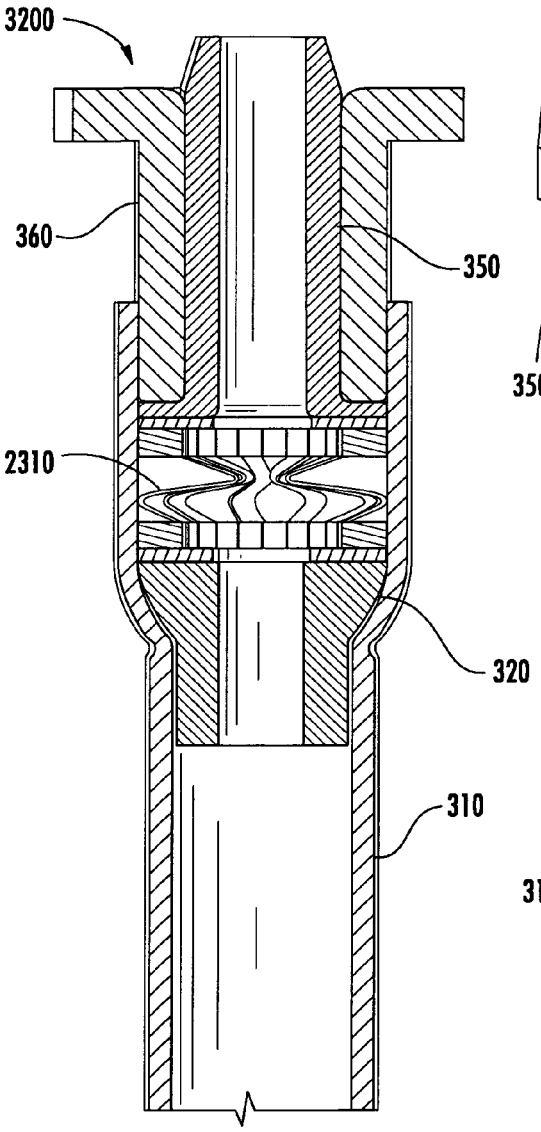
FIG. 32 is an elevation cross-section assembly view of cable interface components with the third adapter embodiment.
Figure 33:
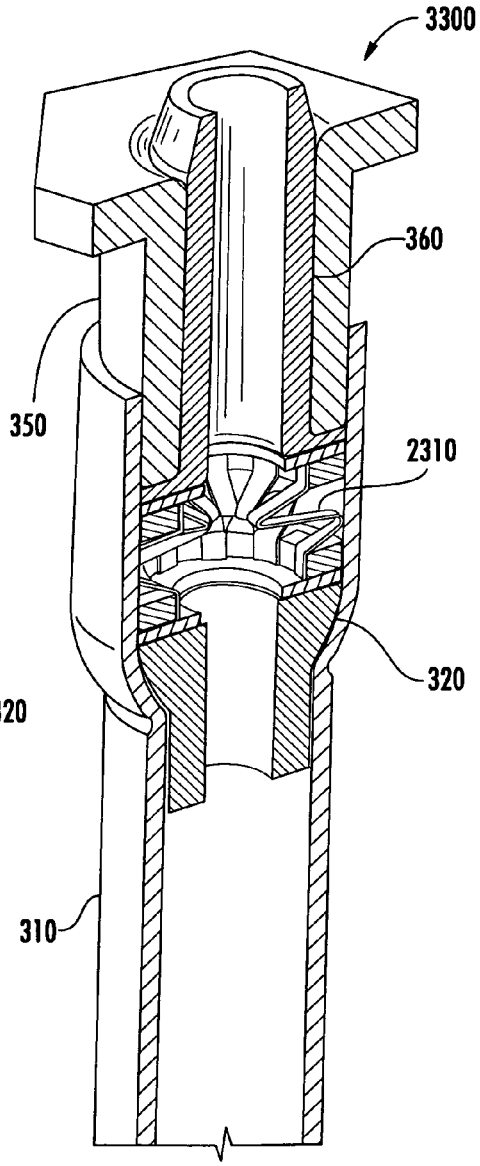
FIG. 33 is a perspective cross-section assembly view of cable interface components with the third adapter embodiment.

FIGS. 32 and 33 show respective elevation and perspective assembly cross-section views 3200 and 3300 of the cable interface with the third adapter embodiment. A pair of adaptors 2310 contact the cable 170 within the interface assembly between the two retainers 330 flanked by the two washers 340, which are sandwiched by the interior and exterior seals 320, 350. The environmental jacket 1010 can also be employed assembly for protection from atmospheric elements.

The conductive adapter 2310 for the "lantern" design constitutes a cut sheet with two parallel border strips 2120 and 2125 that in rolled-form produce corresponding parallel rings 2320 and 2325. These rings 2320 and 2325 are connected together by a number of ribs 2340, and also include tabs 2330 cut orthogonal to the borders. The ribs 2340 and tabs 2330 can be scored for controlled deformation of the sheet 2110.

The conductive adapter 2310 is designed to elastically deform into an annular cage form. The strip 2110 (cut from a metal sheet) can be rolled along an axis parallel to the slats 2140 to form the annular cage structure for insertion between and secured by two conductive retainers 330. Tabs 2130 cut into the strip 2110 are bent outward to secure the strip 2110 now rolled into the adapter 2310 and to prevent the conductive retainers 330 from slipping toward the center of the adapter 2310 under compressive loads. The ribs 2340, when compressed, bend along the scoring marks creating contact fingers that simultaneously extend radially inward and outward as inner edges 2250 and outer edges 2260 while compressing the cage structure. This enables the ribs 2340 to concurrently center themselves on the shield of the cable 170 and within the swage tube 310. The simultaneous extension allows this adapter 2310 to accommodate the widest variety of cables and tube sizes.

An additional feature that can be implemented on the "lantern" design is the addition of "teeth" to the inner finger contacts. As the inner finger edges 2250 extend and make contact with the cable 170, the teeth 2910 pierce the cable jacket to make ohmic contact with the conductive cable shield 2930. This implementation of the "lantern" design provides a unique means by which a cable 170 can be grounded without physically cutting away part of the jacket. Removing the necessity to cut away the jacket obviates exposure of the cable shield to the most common source of shield damage. Additionally, this method reduces the areal (i.e., bounded space) exposure of the cable shield to environmental factors that lead to degradation of the ohmic contact between the cable 170 and the ground adapter 2310.

The retainers 330 are designed to have an outer diameter to match the inner diameter of the swage tube 310, which should match the diameter of the adapter 2310 when properly deformed. The retainers 330, when compressed serve as a load path for the compressive load imparted by the gland nut 360 when tightened. This also serves to stabilize the adapter 2310 upon full compression.

Figure 34:
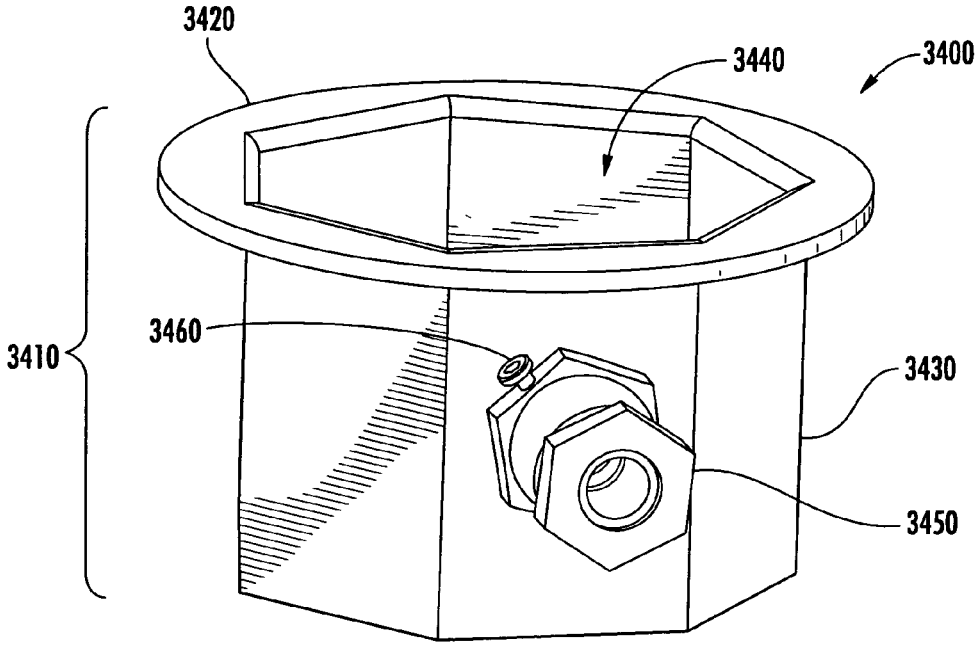
FIG. 34 is a perspective assembly view of a junction box with an cable interface extension.
Figure 35:
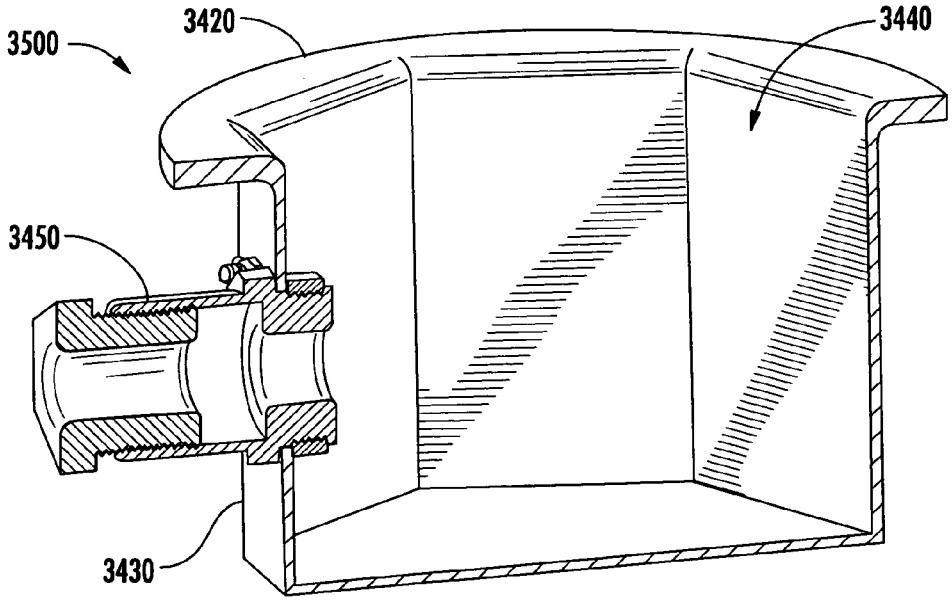
FIG. 35 is a perspective cross-section view of the junction box with the extension.

FIGS. 34 and 35 show assembly and cutaway perspective views of a junction box with a conduit fitting. FIG. 34 illustrates the assembly view 3400 of the exemplary box 3410 having an interface lip 3420, a hexagonal housing 3430 that contains an interior chamber 3440 for environmental protection of cable connections, and an extension 3450 locked into position by a threaded screw 3460. FIG. 35 illustrates the cutaway view 3500 showing the interior of these components.

Figure 36:
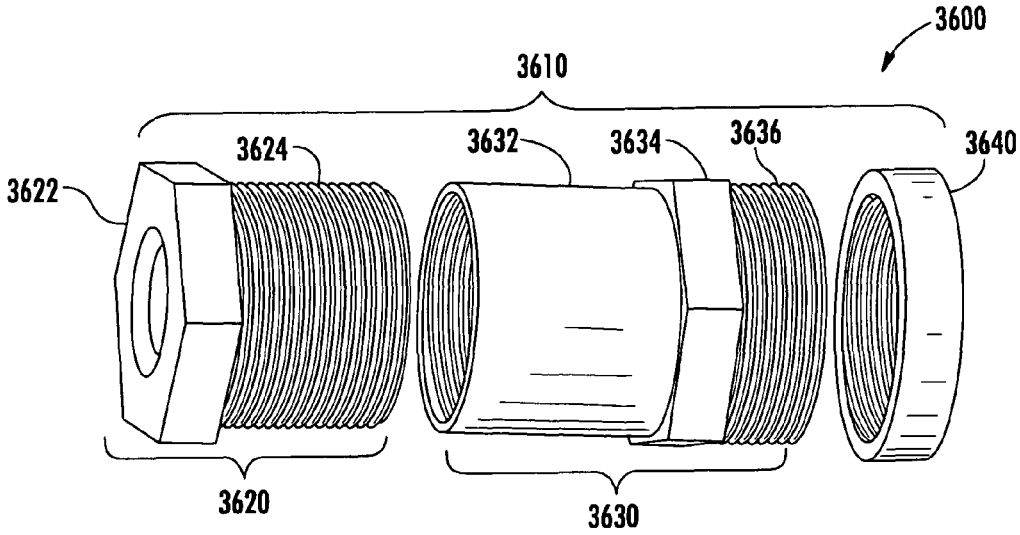
FIG. 36 is a perspective exploded view of extension components.

FIG. 36 shows an exploded perspective view 3600 of components 3610 of the conduit extension 3450 in detail. At the distal end, a boss 3620 includes a hexagonal head 3622 and an externally threaded shank 3624 (similar to the gland nut 360). A sleeve 3630 receives the boss 3620 and includes an internally threaded housing 3632, a hexagonal interface 3634 and an externally threaded stub 3636 for insertion into the junction box housing 3430 and secured by an internally threaded collar 3640.

Figure 37:
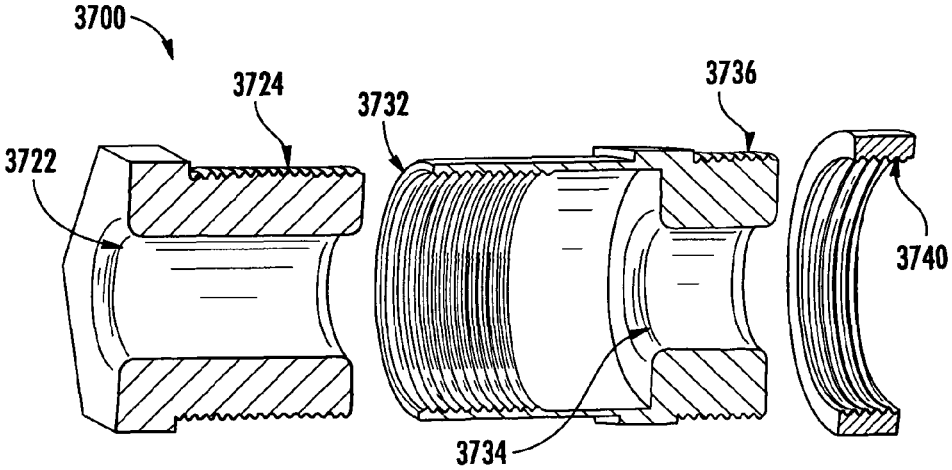
FIG. 37 is a perspective cross-section view of the extension components.

FIG. 37 shows an exploded cutaway view 3700 of these components 3610. The boss 3620 includes an annular opening 3722, and the shank 3624 exhibits a male helical screw thread 3724. The sleeve 3630 includes a reciprocal female helical screw thread 3732 and an annular internal rim 3734 for receiving and restraining the cable 170. The stub 3636 includes a male helical screw thread 3736, and the collar 3640 has a reciprocal female helical screw thread 3740.

Figure 38:
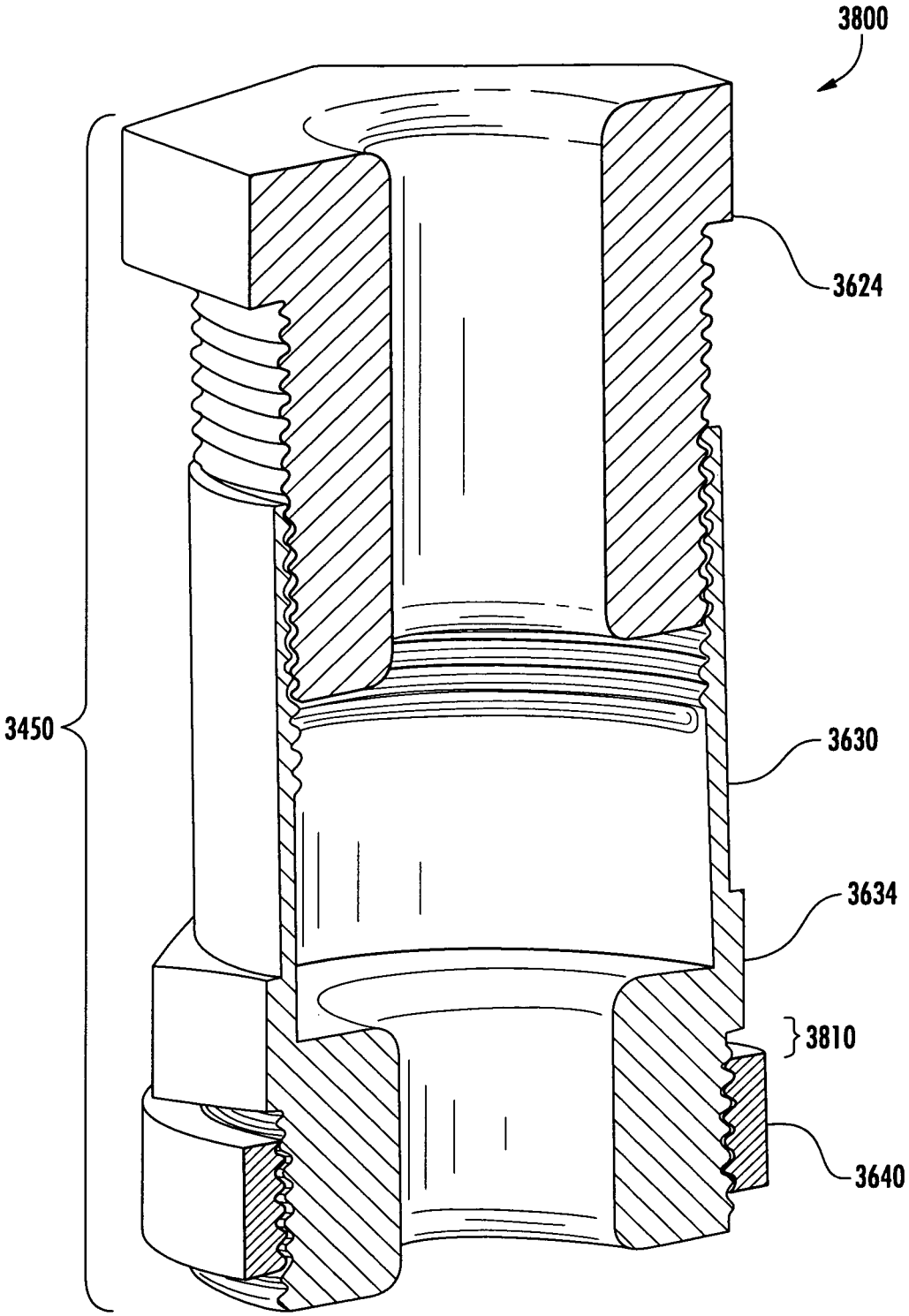
FIG. 38 is a perspective cross-section view of the extension assembly.

FIG. 38 shows an assembly cutaway perspective view 3800 of the conduit extension 3450, showing the boss 3620 inserted into the sleeve 3630. An interface gap 3810 indicates the wall region between the collar 3640 within the chamber 3440 and the hexagonal interface 3634 of the sleeve 3630 to secure the extension 3450 to the junction box housing 3430. The assembled extension 3450 serves as an equivalent bowl section 315 (in a conduit) for the junction box 3610.

Commercial Potential: The commercial potential for the ground shield adapter described within broad and global in nature. The designs can be used for commercial as well as naval ship construction. Due to the inherent design tolerance for either Society of Automotive Engineers (SAE) or metric dimensions for swage tubes 310, the design can be utilized for both domestic and foreign ship construction. Although designed with maritime applications in mind, the designs can also be utilized for general construction practices where swage tubes or breach type fittings might be required for facility cable penetrations that require grounding, stabilization, or weather sealing.

Reason: The United States Navy utilizes hundreds of topside components that require electrical power or signal connections to systems internal to the ship via cable. Because of the complex and system hostile EM environment the connecting cables must be protected from unwanted EM coupling to the signal or power cable. The cables therefore are protected from the EM environment by a conductive cable shield grounded via a CSGA to the ship's bulkhead.

Current CSGA technologies utilized by the Navy are difficult to manufacture due to machining, difficult to install, repair and replace due to design characteristics, have relatively short service life due to poor environmental design, and are very expensive (approximately $300.00 per unit in quantity). The Navy also currently purchases CSGAs in multiple sizes due to the conventional CSGAs inability to adapt to multiple swage tube sizes or cable diameters. This significantly increases acquisition, logistics and design costs. The strategic goal of the proposed design is to provide the Navy a cost efficient technology that can significantly reduce total ownership costs via acquisition maintenance and logistics across the fleet.

Advantages: The new designs utilize relatively few parts with most components being common to all three designs with the exception of the grounding diaphragm. Common components include environmental seals that also perform as stabilizing structural components for cable centering and conductive spacers that perform diaphragm deformation control functions. The grounding diaphragm itself is a cut stamped component made out of conductive sheeting.

The sheeting can be any useable conductive material depending on application such as brass, copper, stainless steel, aluminum or carbon impregnated sheeting. The required thickness of the sheeting depends on the design. The exemplary designs also utilize all components of the stuffing tube assembly. This includes the brass gland nut used as an integrating component and currently unused for shielded cable applications due to design characteristics of conventionally available CSGAs. Conventionally, CSGA assembly discards the gland nut, resulting in waste higher incurred costs to the Navy.

Alternatives include: [1] Use of conventional CSGA designs examples of which are described within this disclosure. [2] Use of a grounding technology proposed by Northrop Grumman Ship Builders (NGSB) known for its use of Double Optimized Braid (DOB) Cable Shielding. This material approach uses bronze or brass wool as the material matrix that provides grounding between the cable shield and the swage tube. The material has a relatively high surface area to volume ratio that lends concern to issues of corrosion and loss of effective grounding. This wool greatly simplifies replacement of the grounding material.

Cut-less Cable Shield Grounding Sleeve: The Cut-less Cable Shield Grounding Sleeve is a device whereby a typical cable shield ground adapter can be provided good ohmic contact with a cable shield without removal of the cable protective jacket. The exemplary device described herein is formed from a single sheet stamping 2610 of an appropriate conductive material such as copper, stainless steel or aluminum. The sheet can be stamped so that at least two rows of small teeth 2620 and 2630 protrude on one side. These teeth, in the exemplary implementation, can be arranged in orthogonal directions to provide stability for the collar when the sheet's ends 2640 and 2650 join together, and the resulting sleeve 2710 is properly installed.

Testing of correctly installed conventional CSGAs in stuffing tube installations has yielded an average direct current (DC) resistance of approximately 10 milliohms (mΩ). Testing of early prototypes of the new exemplary CSGA design has yielded an average DC resistance of 7 mΩ or less based on design tested. Early results indicate that the DC resistance of the new design is at least comparable to conventional designs.

Dimensions of exemplary stuffing or swage tubes 310 are available from Research Tool & Die Works in Carson, Calif. For example, the D-size stuffing tube, as indicated in http://www.rtnd.com/catalog/4-8.pdf, includes an inner diameter of 1¼", and a throat length of 1⅝". The proposed diameter of the first embodiment would be slightly larger to ensure a circumferential contact by an interference fit with the inside of the swage tube 310.

The length of the second and third embodiments would match the circumference of the inner ring, 330. This exemplary ring has a diameter that is approximately ¼" less than the diameter of the swage tube 310. The particular dimensions identified herein represent explanatory examples and are not limiting. Thus, other stuffing tube and conduit sizes can be contemplated within the spirit of the claims. MIL-S-24235/2C provides the military standard dimensions for electrical cable packaging MIL-S-24235, available at http://dornequipment.com/milspecs/pdf/24235-2C.pdf.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An adapter for electrically connecting an interior surface of a conduit and an external surface of a cable, said adapter comprising:

an electrically conductive and mechanically flexible sheet having first and second edges that can face each other, said sheet being configured to form an annulus that mechanically contacts the external surface of the cable and a periphery that mechanically contacts the inner surface of the conduit;

wherein said sheet forms a linear ribbon having first and second longitudinal sides, said sheet configured such that said ribbon can be rolled to connect said first and second edges substantially join together to form an annulus, at least one of said sides having a plurality of wings that extend laterally therefrom;

wherein said wings are ribs that extend radially inward to contact the outer surface of the cable and outward to contact the inner surface of the conduit as said sides axially push towards each other.

2. The adapter according to claim 1, wherein said wings are tabs that can be bent to alternatingly extend radially inward and outward.

3. The adapter according to claim 1, wherein said sheet forms a linear ribbon having a longitudinal side, with said ribbon having laterally extending tabs distributed along said side, said sheet being configured such that said ribbon can be rolled to connect said first and second edges substantially join together to form an annulus, and said tabs can be bent to alternatingly extend radially inward and outward.

4. The adapter according to claim 1, wherein said sheet forms a circular plate having a radial opening that forms said annulus and a radial rim that forms said periphery, and said first and second edges constitute a split in said plate that radially extends from said annulus to said periphery.

5. The adapter according to claim 4, wherein said sheet includes radial slits distributed around said circular plate, said slits extending between said annulus and said periphery.

6. The adapter according to claim 1, wherein said sheet forms a linear ribbon having outer longitudinal sides, having lateral cutouts to form a plurality of regular gaps interspersed between said sides, said sheet being configured such that said ribbon can be rolled to connect said first and second edges substantially join together to form an annulus, said gaps forming ribs therebetween, said ribs extending radially inward to contact the outer surface of the cable and outward to contact the inner surface of the conduit as said sides axially push towards each other.

7. The adapter according to claim 6, wherein said cutouts additionally form a plurality of regular tabs longitudinally distributed between said gaps, and said tabs can be bent to extend radially outward.

8. The adapter according to claim 6, further including an electrically conductive sleeve that annularly contacts said ribs at inwardly extending locations, said sleeve having teeth to mechanically penetrate a jacket around the cable.

9. An electrical conduit ground device for electrically and environmentally shielding an electric cable, said device comprising:

a conduit having a receiving end through which the cable passes axially;

an internal seal that inserts into said receiving end;

a gland boss that inserts into said receiving end;

an external seal that inserts into said boss and extends axially outward from said receiving end; and a grounding assembly disposed between said internal and external seals;

wherein said grounding assembly further includes:

an adapter for providing electrical grounding contact between the cable and said swage tube;

a space-retainer for structurally supporting said adapter; and a washer for axially separating said internal and external seals;

wherein said sheet forms a linear ribbon having first and second longitudinal sides, said sheet configured such that said ribbon can be rolled to connect said first and second edges substantially join together to form an annulus, at least one of said sides having a plurality of wings that extend laterally therefrom;

wherein said Wings are ribs that extend radially inward to contact the outer surface of the cable and outward to contact the inner surface of the conduit as said sides axially push towards each other.

10. The device according to claim 9, wherein said conduit constitutes a swage tube.

11. The device according to claim 9, wherein said conduit is a junction box extension.

12. The device according to claim 9, wherein said wings are tabs that can be bent to alternatingly extend radially inward to contact the cable and outward to contact said conduit, and an opposite side of said sides faces an inner cylindrical surface of said retainer.

13. The device according to claim 9, wherein said sheet forms a linear ribbon having a longitudinal side, with said ribbon having laterally extending tabs distributed along said side, said sheet being configured such that said ribbon can be rolled to connect said first and second edges substantially join together to form an annulus, and said tabs can be bent to alternatingly extend radially inward and outward.

14. The device according to claim 9, wherein adapter comprises: an electrically conductive and mechanically flexible sheet having first and second edges that can face each other, said sheet being configured to form an annulus that mechanically contacts the cable and a periphery that mechanically contacts the conduit.

15. The device according to claim 14, wherein said sheet forms a circular plate having a radial opening that forms said annulus and a radial rim that forms said periphery, and said first and second edges constitute a split in said plate that radially extends from said annulus to said periphery.

16. The device according to claim 15, wherein said sheet includes radial slits distributed around said circular plate, said slits extending between said annulus and said periphery.

17. The device according to claim 9, wherein said sheet forms a linear ribbon having outer longitudinal sides, having lateral cutouts to form a plurality of regular gaps interspersed between said sides, said sheet being configured such that said ribbon can be rolled to connect said first and second edges substantially join together to form an annulus, said gaps forming ribs therebetween, said ribs extending radially inward to contact the cable and outward to contact said conduit as said sides axially push towards each other.

18. The device according to claim 17, wherein said cutouts additionally form a plurality of regular tabs longitudinally distributed between said gaps, and said tabs can be bent to extend radially outward.

19. The device according to claim 17, further including an electrically conductive sleeve that annularly contacts said ribs at inwardly extending locations, said sleeve having teeth to mechanically penetrate a jacket around the cable.

* * * * *